US007648349B2

(12) United States Patent
Hogan

(10) Patent No.: US 7,648,349 B2
(45) Date of Patent: Jan. 19, 2010

(54) NUTATING PUMP WITH REDUCED PULSATIONS IN OUTPUT FLOW

(75) Inventor: Tim Patrick Hogan, Round Lake Beach, IL (US)

(73) Assignee: Fluid Management Operations, LLC, Wheeling, IL (US)

( * ) Notice: Subject to any disclaimer, the term of this patent is extended or adjusted under 35 U.S.C. 154(b) by 499 days.

(21) Appl. No.: 11/359,051

(22) Filed: Feb. 22, 2006

(65) Prior Publication Data

US 2007/0196223 A1 Aug. 23, 2007

(51) Int. Cl.
*F04B 19/00* (2006.01)
*F04B 7/06* (2006.01)

(52) U.S. Cl. ..... 417/500; 417/486; 417/492

(58) Field of Classification Search ..... 417/20, 417/42, 50, 53, 250, 326, 329, 403, 415, 417/500, 492, 486, 535; 91/61
See application file for complete search history.

(56) References Cited

U.S. PATENT DOCUMENTS 3,447,468 A * 6/1969 Kinne ..... 417/403
4,008,003 A * 2/1977 Pinkerton ..... 417/250
5,482,448 A * 1/1996 Atwater et al. ..... 417/492
6,398,513 B1 6/2002 Amsler et al.
6,540,486 B2 4/2003 Amsler et al.
6,732,647 B2 * 5/2004 Uera et al. ..... 101/366
6,749,402 B2 6/2004 Hogan et al.
2004/0013531 A1 * 1/2004 Curry et al. ..... 417/42

* cited by examiner

*Primary Examiner*—Devon C Kramer
*Assistant Examiner*—Todd D Jacobs
(74) *Attorney, Agent, or Firm*—Miller Matthias & Hull

(57) ABSTRACT

A nutating pump is disclosed which has a modified piston and housing or casing that provides two distinct pump chambers or areas. Output from the first pump chamber is delivered during a first half of the dispense cycle or the piston movement cycle. A substantial portion of this output is held for delivery by the second chamber during a second part or half of the dispense cycle. Thus, the output generated by the pump is not altered or reduced, it is delivered over the entire piston movement cycle as opposed to prior art pumps which deliver all of the fluid during a first half or first portion of the piston movement cycle. In this way, superior pulse modification is achieved as fluid is delivered across the entire piston movement cycle as opposed to a first half or first portion of the piston movement cycle. In additional embodiments disclosed, two distinct chambers are also provided but each chamber generates its own output as the piston includes two machined or flat sections for active pumping. Thus, each chamber generates its own positive output flow but the flow from each chamber is delivered during a different half of the piston movement cycle. Thus, the flow is still distributed throughout the entire piston movement cycle. In the first embodiment with a first and second chamber, the second chamber essentially acts as a holding station for fluid to be delivered during a second half of the piston movement cycle.

24 Claims, 17 Drawing Sheets

NUTATING PUMP WITH REDUCED PULSATIONS IN OUTPUT FLOW

BACKGROUND

1. Technical Field

Improved nutating pumps are disclosed with piston designs that provide output flow in both the first and second parts of the piston rotation/reciprocation cycle thereby providing about, half the normal flow rate during the first part of the cycle as a conventional piston but also about that same flow rate during the second part of the cycle in contrast to prior art nutating pumps where there is no flow rate for second part or intake portion of the cycle. The result is smoother, reduced pulsation flow and an overall cycle dispense amount about equal to a conventional nutating pump but with less pulsations and splashing. The nutating pumps have numerous applications where accuracy and speed are important.

2. Description of the Related Art

Nutating pumps are pumps having a piston that both rotates about its axis liner and contemporaneously slides axially and reciprocally within a line or casing. The combined 360° rotation and reciprocating axial movement of the piston produces a sinusoidal dispense profile that is illustrated in FIG. 1A. In FIG. 1A, the sinusoidal profile is graphically illustrated. The line 1 graphically illustrates the flow rate at varying points during one revolution of the piston. The portion of the curve 1 above the horizontal line 2 representing a zero flow rate represents the output while the portion of the curve 1 disposed below the line 2 represents the intake or "fill." Both the pump output and pump intake flow rates reach both maximum and minimum levels and therefore there is no linear correlation between piston rotation and either pump output or pump intake.

The colorant dispensers disclosed in U.S. Pat. Nos. 6,398,513 and 6,540,486 (Amsler '513 and Amsler '486) utilize a nutating pump and a computer control system to control the pump. Prior to the system disclosed by Amsler et al., existing nutating pumps were operated by rotating the piston through a full 360° rotation and corresponding axial travel of the piston. Such piston operation results in a specific amount of fluid pumped by the nutating pump with each revolution of the piston. Accordingly, the amount of fluid pumped for any given nutating pump is limited to multiples of the specific volume. If a smaller volume of fluid is desired, then a smaller sized nutating pump is used or manual calibration adjustments are made to the pump.

For example, in the art of mixing paint, paint colorants can be dispensed in amounts as little as 1/256th of a fluid ounce. As a result, existing nutating pumps for paint colorants can be very small. With such small dispense amount capabilities, the motor of such a small pump would have had to run at excessive speeds to dispense larger volumes of colorant (multiple full revolutions) in an appropriate time period.

In contrast, larger pumps may be used to minimize the motor speed. When small dispense amounts are needed, a partial revolution dispense for such a larger capacity nutating pump would be advantageous. However, using a partial revolution to accurately dispense fluid is difficult due to the non-linear output of the nutating pump dispense profile vs. angle of rotation as shown in FIG. 1A.

To address this problem, the disclosures of Amsler '513 and '486 divide a single revolution of the pump piston into a plurality of steps that can range from several steps to four hundred steps or more. Controllers and algorithms are used with a sensor to monitor the angular position of the piston, and using this position, calculate the number of steps required to achieve the desired output. Various other improvements and methods of operation are disclosed in Amsler '513 and '486.

The sinusoidal profile illustrated in FIG. 1A is based upon a pump operating at a constant motor speed. While operating the pump at a constant motor speed has its benefits in terms of simplicity of controller design and pump operation, the use of a constant motor speed also has inherent disadvantages, some of which are addressed in U.S. Pat. No. 6,749,402 (Hogan et al.).

Specifically, in certain applications, the maximum output flow rate illustrated on the left side of FIG. 1A can be disadvantageous because the output fluid may splash or splatter as it is being pumped into the output receptacle at the higher flow rates. For example, in paint or cosmetics dispensing applications, any splashing of the colorant as it is being pumped into the output container results in an inaccurate amount of colorant being deposited in the container but also colorant being splashed on the colorant machine which requires labor intensive clean-up and maintenance. Obviously, this splashing problem will adversely affect any nutating pump application where precise amounts of output fluid are being delivered to an output receptacle that is either full or partially full of liquid or small output receiving receptacles.

For example, the operation of a conventional nutating pump having the profile of FIG. 1A results in pulsed output flow as shown in FIGS. 1B and 1C. The pulsed flow shown at the left in FIGS. 1B and 1C, at speeds of 800 and 600 rpm respectively, results in pulsations 3 and 4 which are a cause of unwanted splashing. FIGS. 1B and 1C are renderings of actual digital photographs of an actual nutating pump in operation. While reducing the motor speed from 800 to 600 rpm results in a smaller pulse 4, the reduction in pulse size is minimal and the benefits are offset by the slower operation. To avoid splashing altogether, the motor speed would have to be reduced substantially more than 20% thereby making the choice of a nutating pump less attractive despite its high accuracy. A further disadvantage to the pulsed flow shown in FIG. 1A is an accompanying pressure spike that cause an increase in motor torque.

In addition to the splashing problem of FIG. 1A, the large pressure drop that occurs within the pump as the piston rotates from the point where the dispense rate is at a maximum to the point where the intake rate is at a maximum (i.e. the peak of the curve shown at the left of FIG. 1A to the valley of the curve shown towards the right of FIG. 1A) can result in motor stalling for those systems where the motor is operated at a constant speed. As a result, motor stalling will result in an inconsistent or non-constant motor speed, there by affecting the sinusoidal dispense rate profile illustrated in FIG. 1A, and consequently, would affect any control system or control method based upon a preprogrammed sinusoidal dispense profile. The stalling problem will occur on the intake side of FIG. 1A as well as the pump goes from the maximum intake flow rate to the maximum dispense flow rate.

The splashing and stalling problems addressed by Hogan et al. are illustrated partly in FIG. 2 which shows a modified dispense profile 1 a where the motor speed is varied during the pump cycle to flatten the curve 1 of FIG. 1A. The variance in motor speed results in a reduction of the peak output flow rate while maintaining a suitable average flow rate by (i) increasing the flow rates at the beginning and the end of the dispense portion of the cycle, (ii) reducing the peak dispense flow rate, (iii) increasing the duration of the dispense portion of the cycle and (iv) reducing the duration of the intake or fill portion of the cycle. This is accomplished using a computer algorithm that controls the speed of the motor during the cycle thereby increasing or decreasing the motor speed as necessary to achieve a dispense curve like that shown in FIG. 2.

However, the nutating pump design of Hogan et al. as shown in FIG. 2, while reducing splashing, still results in a start/stop dispense profile and therefore the dispense is not a pulsation-free or completely smooth flow. Despite the decrease in peak dispense rate, the abrupt increase in dispense rate shown at the left of FIG. 2 and the abrupt drop off in flow rate shown at the center of FIG. 2 still provides for the possibility of some splashing. Further, the abrupt starting and stopping of dispensing followed by a significant lag time during the fill portion of the cycle still presents the problems of significant pressure spikes and bulges and gaps in the fluid stream exiting the dispense nozzle. Any decrease in the slope of the portions of the curves shown at 1*a*, 1*c* would require in increase in the cycle time as would any decrease in the maximum fill rate. Thus, the only modifications that can be made to the cycle shown in FIG. 2 to reduce the abruptness of the start and finish of the dispensing portion of the cycle would result in increasing the cycle time and any reduction in the maximum fill rate to reduce pressure spiking and motor stalling problems would also result in an increase in the cycle time.

Accordingly, there is a need for approved nutating pump with an improved control system and/or a method of control thereof where by the pump motor is controlled so as to reduce the likelihood of splashing and "pulsing" during dispense without compromising pump speed and accuracy.

SUMMARY OF THE DISCLOSURE

In satisfaction of the aforenoted needs, a nutating pump design is disclosed which includes two pump chambers or pumping areas within the pump. Prior art nutating pumps include a single pump chamber or area. The output from the additional pump chamber of the disclosed embodiments occurs during a different part of the piston cycle than that of the primary or first pump chamber thereby distributing the output over the entire piston or pump cycle as opposed to half or part of the cycle.

In one refinement, the disclosed nutating pump comprises a rotating and reciprocating piston disposed in a pump housing. The housing comprises an inlet and an outlet. The inlet and outlet each are in fluid communication with an interior of the housing. The housing also comprises a middle seal. The piston comprises a proximal section connected to a pump section at a first transition section. The proximal section is linked to a motor and the proximal section has a first maximum outer diameter. The pump section of the piston has a second maximum outer diameter that is greater than the first maximum outer diameter. The pump section also comprises a distal flat or recessed section disposed opposite the pump section from first transition section. The pump section extends between the first transition section and a distal end. The pump section of the piston is at least partially and frictionally received in the middle seal of the housing.

In a refinement, a passageway extends around the middle seal and provides communication between the first and second pump chambers.

In another refinement, a passageway extends outside the housing connects the second chamber to the outlet.

In another refinement, the housing comprises a distal seal section in which the distal end of the pump section of the piston is frictionally received. In related refinement, the distal seal section also helps to define the first pump chamber. In another related refinement, the distal seal section abuts an end cap which also helps to define the first pump chamber.

In another refinement, the proximal section of the piston passes through a proximal seal that also helps to define the second pump chamber.

In another refinement, the inlet and the outlet are disposed on opposing sides of the middle seal.

In another refinement, the inlet and the outlet are disposed on a same side of the middle seal.

In another refinement, the inlet, the outlet and the first pump chamber are disposed on the same side of the middle seal.

In another refinement, the piston comprises a distal extension extending from the distal end of the pump section, the distal extension having a third maximum outer diameter that is smaller than the second diameter, the distal extension passing through a distal seal that helps define the first pump chamber. In a related refinement, the third and first diameters are about equal.

In another refinement, the pump further comprises a second inlet leading into the second chamber.

In another refinement, the piston further comprises a proximal recessed section that helps to define the second pump chamber. In a related refinement, the distal and proximal recessed sections are in alignment with each other. In another related, but different refinement, the distal and proximal flat sections are disposed diametrically opposite the pump section of the piston from each other.

In another refinement, the disclosed pump comprises a controller operatively connected to the motor. The controller generates a plurality of output signals including at least one signal to vary the speed of the motor.

In another refinement, the first maximum outer diameter is about 0.707 times the second maximum outer diameter.

In another refinement, multiple pistons, or multiple nutating pump assemblies may be combined with proper timing, to achieve similar improvement in flow patterns.

As noted above, the housing and piston define two pump chambers including (i) a first or first chamber defined by the distal recessed section and distal end of the pump section of the piston and the housing, and (ii) a second chamber defined by the first transition section and proximal section of the piston and the housing. The first and second pump chambers are axially isolated from each other by the middle seal section and pump sections of the piston, however, both the first and second pump chambers are in communication with the outlet.

In one embodiment, the second chamber has no net flow per piston revolution; all of the outlet flow occurs during the first half-revolution of the piston and no outlet flow occurs during the second half-revolution of the piston. Such a disclosed design uses the second chamber to remove a displaced volume equal to half of the fluid exiting the first chamber in the first half of the piston revolution. The second chamber then returns this volume to the outlet in the second half of the revolution, when there would be no flow provided by prior art designs (see FIGS. 1A and 2). Thus, the output of the dispense part of the cycle is about halved but the reduced amount is dispensed during the fill part of the cycle thereby compensating for any lost output during the first part of the cycle.

The first and second chambers are only "chambers" in a loose sense. There is no real barrier on either the upstream, or downstream side of either the first or second chambers. With respect to the second chamber, fluid is free to flow around the proximal and pump sections piston that are disposed in the second chamber while the piston is moving axially and rotating. The displacement within the second chamber is caused by the axial movement of the piston and the stepped structure (first transition section) that exists between the proximal and pump sections of the piston. This displacement caused by the axial movement of this stepped structure is equal to the annular area, or the difference between the second and first maximum outer diameters, multiplied by the axial movement. For example, if the first maximum diameter of the proximal section of the piston (or the inner diameter of the small proximal seal) is 0.7071 times the second maximum outer diameter of the pump section of the piston (or the inner diameter of the middle seal), this annular area is one-half the area of the piston in the first chamber.

As a result, the disclosed nutating pumps reduce the peak flow rate, produce output in both portions of the dispense cycle, and make the flow pulsations less severe, thereby reducing or eliminating the occurrence of splashing, pressure spikes and motor stalling.

Although any diameter could be used, a reduced diameter for the proximal section of the piston that is 0.7071 times the diameter of the main section or pump section of the piston diameter, the displacement of the second chamber will be one-half that of the first chamber, resulting in a smooth flow.

In a refinement, the flow from the first chamber is routed entirely through the second chamber, to eliminate unflushed "dead" volumes, and to prevent or remove air pockets.

In another refinement, both ends or both the proximal and distal sections of the piston are reduced in diameter, with proximal and distal seals, one for each end. This concept requires both chambers to flow in parallel or a positive net flow from both chambers. This is in contrast to a single reduced diameter piston as described above which has no net flow from the second chamber. Having a net flow from the second chamber requires this chamber to have its own inlet port, outlet port, and a machined flat section of the piston to allow for the valving/pumping action. In order to cause the flow from the second chamber to be in opposite timing to the first chamber, the orientation of the inlet and outlet tubing can be interchanged so the proximal portion of the pump section of the piston with the proximal machined distal recessed section can be moved opposite with respect to the distal recessed section, or some other method or combination of methods may be used.

The disclosed nutating pump designs provide new moderated flow patterns and therefore require new algorithms for making accurate dispenses of partial revolution volumes, compared to the pump designs disclosed in Amsler et al. and Hogan et al., both of which are commonly assigned with the present application and incorporated herein by reference.

The disclosed pumps can be subject to further pulse-reduction by modulating the motor speed as disclosed in Hogan et al., although the precise patterns of modulation will be different.

Further advantages of the disclosed pumps include the concept that the peak flow per motor step (or motor angular rotation) is one-half that of the original pump design, allowing for increased resolution and accuracy of small dispense amounts from the pump. This is particularly true of the partial-revolution dispenses done while taking into account the flow during each portion of the rotation.

Other advantages and features will be apparent from the following detailed description when read in conjunction with the attached drawings.

BRIEF DESCRIPTION OF THE DRAWINGS

The disclosed embodiments are illustrated more or less diagrammatically in the accompanying drawings, wherein.

It will be noted that the drawings are not necessarily to scale and that the disclosed embodiments are sometimes illustrated by graphic symbols, phantom lines, diagrammatic representations and fragmentary views. In certain instances, details may have been omitted which are not necessary for an understanding of the disclosed embodiments or which render other details difficult to perceive. It should be understood, of course, that this disclosure is not limited to the particular embodiments illustrated herein.

DETAILED DESCRIPTION OF THE PRESENTLY PREFERRED EMBODIMENTS

Figure 1A:
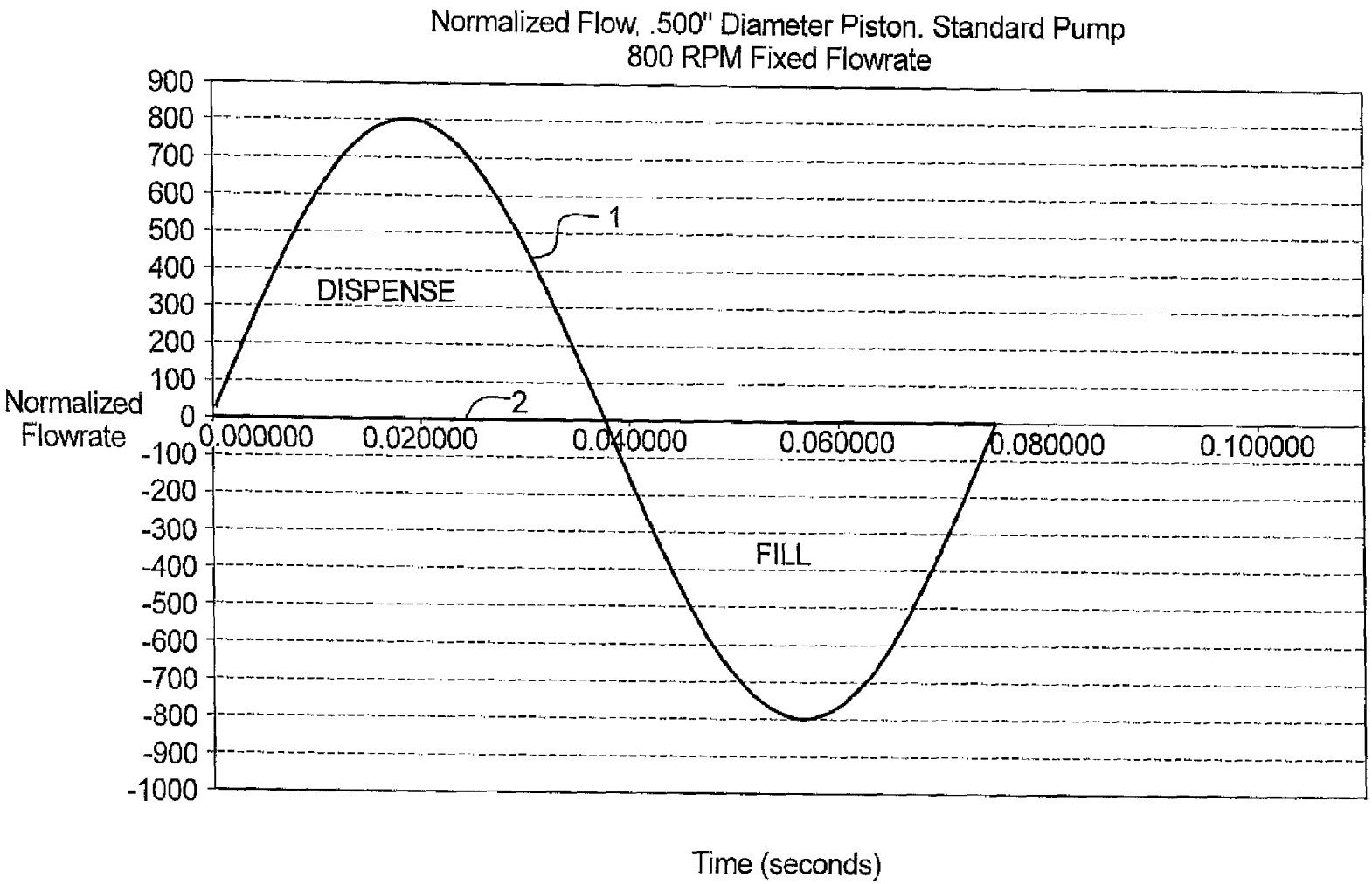
FIG. 1A (PRIOR ART)
FIG. 1A illustrates, graphically, a prior art dispense/fill profile for a prior art nutating pump operated at a fixed motor speed.
Figure 1B:
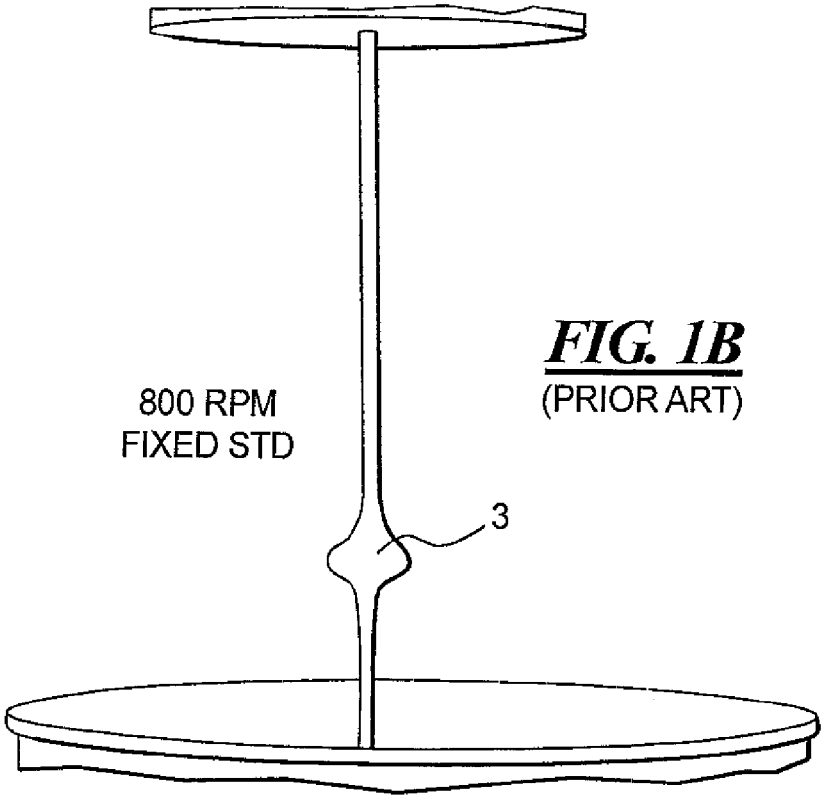
FIG. 1B (PRIOR ART)
FIG. 1B is a rendering from a photograph illustrating the pulsating dispense stream of the pump, the operation of which is graphically depicted in FIG. 1A.
Figure 1C:
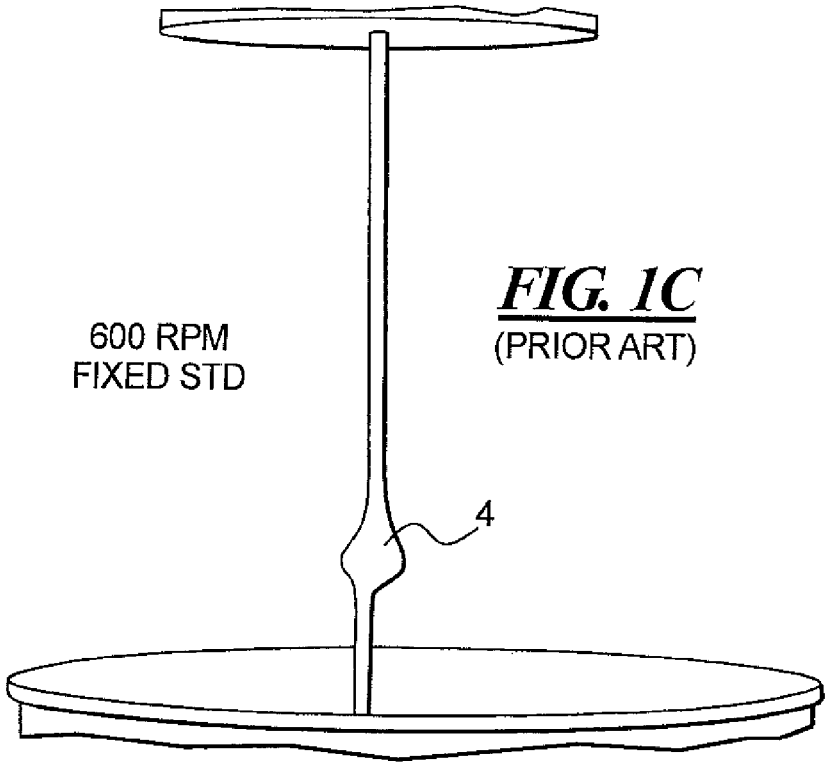
FIG. 1C (PRIOR ART)
FIG. 1C is another rendering of a photograph of an output stream of a prior art pump operated at a constant, but slower motor speed.
Figure 1D:
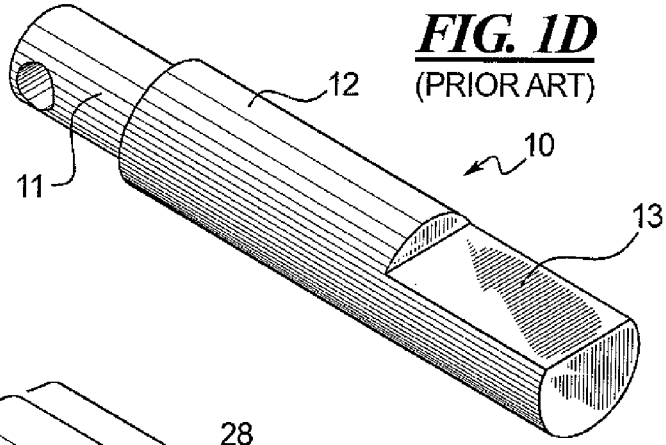
FIG. 1D (PRIOR ART)
FIG. 1D is a perspective view of a prior art nutating pump piston.

Turning first to FIG. 1D, a prior art piston 10 is shown with a narrower portion 11 that is linked or coupled to the motor. The wider section 12 is the only section disposed within the pump chamber. The wider section 11 includes a flattened portion 13 which is the active pumping area. The differences between the prior art piston 10 of FIG. ID and the pistons of this disclosure will be explained in greater detail below.

Figure 6A:
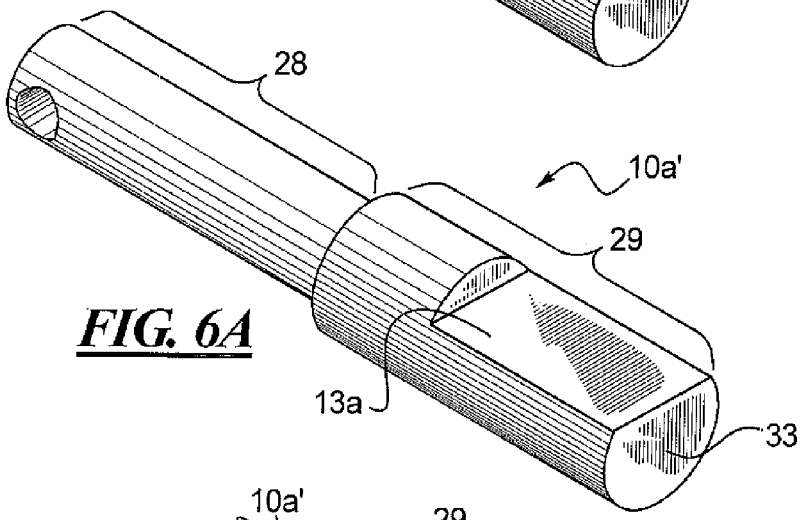
FIGS. 6A-6D are perspective, side, plan and end views of a nutating pump piston made in accordance with this disclosure.

Turning to FIGS. 3A-3D, a nutating pump 20 is shown. The pump 20 includes a rotating and reciprocating piston 10A that is disposed within a pump housing 21. The pump housing 21, in the embodiment illustrated in FIGS. 3A-3B also includes an end cap or head 22. The housing or casing 21 may also be connected to an intermediate housing 23 used primarily to house the coupling 24 that connects the piston 10*a* to the drive shaft 25 which, in turn, is coupled to the motor shown schematically at 26. The coupling is connected to the proximal end 26 of the piston 10*a* by a link 27. A proximal section 28 of the piston 10*a* has a first maximum outer diameter that is substantially less than the second maximum outer diameter of the larger pump section 29 of the piston 10*a*. For a clear understanding of what is meant by "proximal section" and "pump section" 29, see also FIGS. 6A-6C. The purpose of the larger maximum outer diameter of the pump section 29 will be explained in greater detail below. The proximal section 28 is connected to the pump section 29 by a beveled transition section 31. Comparing 3A-3D, it will be noted that the piston 10*a*' shown in FIGS. 6A-6D includes a vertical transition section 31' while the transition section 31 shown in FIGS. 3A-3D is slanted or beveled. Either possibility is acceptable as the orientation shown in FIG. 6 does not affect displacement from the second chamber; the difference in cross sectional areas of the proximal section 28 and the pump section 29 determines displacement.

Returning to FIGS. 3A-3D, the pump section 29 of the piston 10*a* passes through a middle seal 32. The distal end 33 of the pump section 29 of the piston 10*a* is also received in a distal seal 34. A fluid inlet is shown at 35 and a fluid outlet is shown at 36. The proximal section 28 of the piston passes through a proximal seal 38 disposed within the seal housing 39.

Figure 6B:
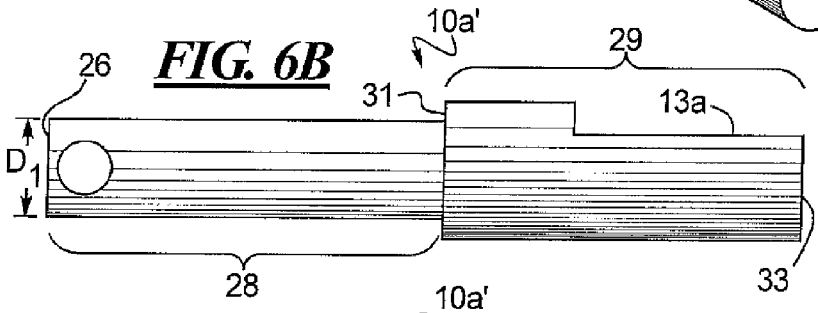
Figure 6D:
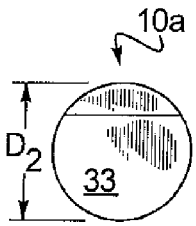
Figure 6C:
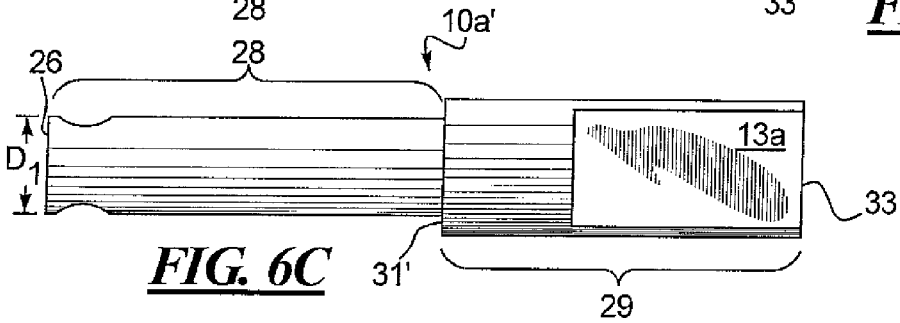

Turning to FIGS. 6B-6D, the first maximum outer diameter $D_1$ of the proximal section 28 and the second maximum outer diameter $D_2$ of the pump section 29 are illustrated. It is the differences in these diameters $D_1$ and $D_2$ that generate displacement in the second chamber. The first pump chamber is shown at 42 in FIGS. 3A, 3B and 3D. The first chamber 42 is covered by the piston 10*a* in FIG. 3C. Generally speaking, the first chamber 42 is not a chamber per se but is an area where fluid is primarily displaced by the axial movement of the piston 10*a* from the position shown in FIG. 3A to the right to the position shown in FIG. 3C as well as the rotation of the piston and the engagement of fluid disposed in the first chamber or area 42 by the machined flat area shown at 13*a* in FIGS. 3B-3D. The machined flat area 13*a* is hidden from view in FIG. 3A. A conduit or passageway shown generally at 43 connects the first chamber 42 to the second chamber or area 44.

Figure 3A:
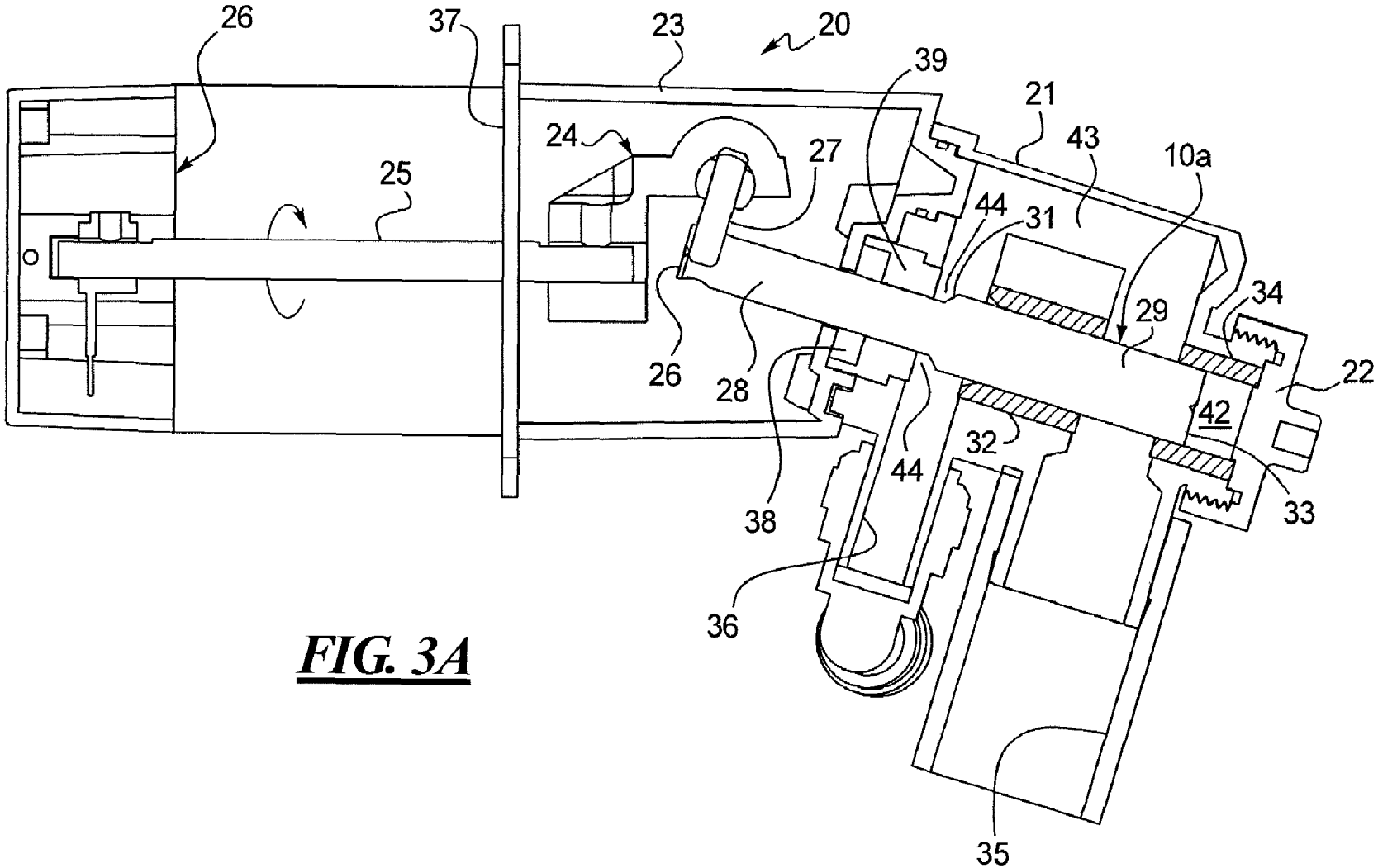
FIG. 3A is a sectional view of a disclosed nutating pump showing the piston at the "bottom" of its stroke with the stepped transition between the smaller proximal section of the piston and the larger pumping section of the piston disposed within the "second" chamber and with the distal end of the piston being spaced apart from the housing or end cap thereby clearly illustrating the "first" pump chamber.

Still referring to FIG. 3A, the piston 10*a* is shown at the "bottom" of its stroke. The transition or step 31 is disposed well within the second chamber 44 and the distal end 33 of the pump section 29 of the piston 10*a* is spaced apart from the head 22. Fluid is disposed within the first chamber 42. The first chamber 42 is considered to be bound by the flat or machined portion 13*a* of the piston 10*a*, the distal end 33 of the pump section 29 of the piston 10*a* and the surrounding housing elements which, in this case, are the distal seal 34 and head 22. It is the pocket shown at 42 in FIG. 3 where fluid is collected between the piston 10*a* and the surrounding structural elements and pushed out of the area 42 by the movement of the piston towards the head 22 or in the direction of the arrow 45 shown in FIG. 3B.

Figure 3B:
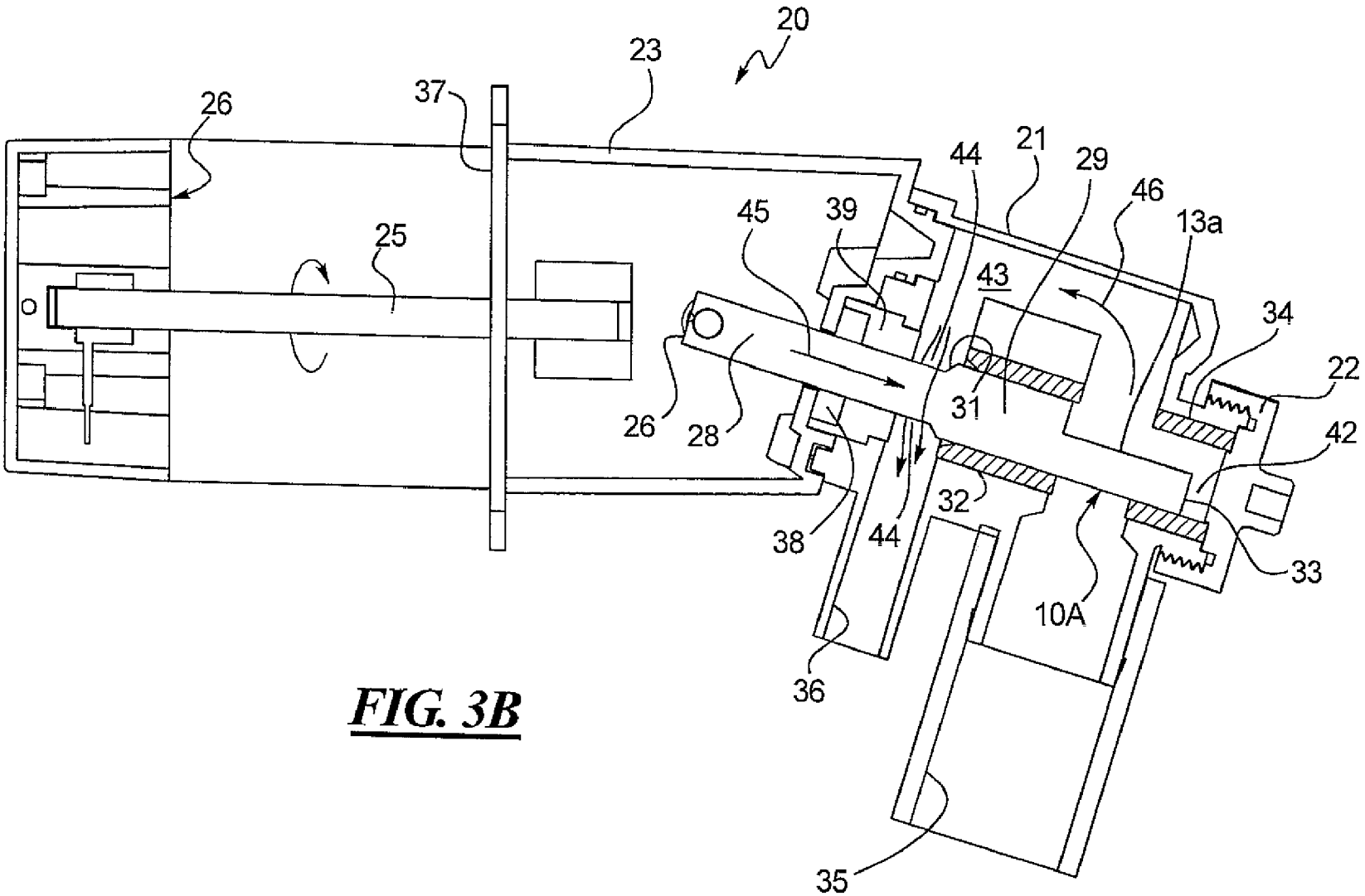
FIG. 3B is another sectional view of the pump shown in FIG. 3A but with the piston having been rotated and moved forward to the middle of its upstroke and clearly illustrating fluid leaving the first chamber and passing through the second chamber.

While the piston 10*a* is at the bottom of its stroke in FIG. 3A, the piston 10*a* has moved to the middle of its stroke in FIG. 3B as the end 33 of the pump section 29 of the piston 10*a* approaches the head 22 or housing structural element (see the arrow 45). As shown in FIG. 3B, fluid is being pushed out of the first pump area or chamber 42 and into the passageway 43 (see the arrow 46). This action displaces fluid disposed in the passageway 43 and causes it to flow around the proximal section 28 and transition section 31 of the piston 10*a*, or through the second chamber 44 as shown in FIG. 3B. It will also be noted that the flat or machined area 13*a* of the piston 10*a* has been rotated thereby also causing fluid flow in the direction of the arrow 46 through the passageway 43 and towards the second chamber or area 44.

Figure 3C:
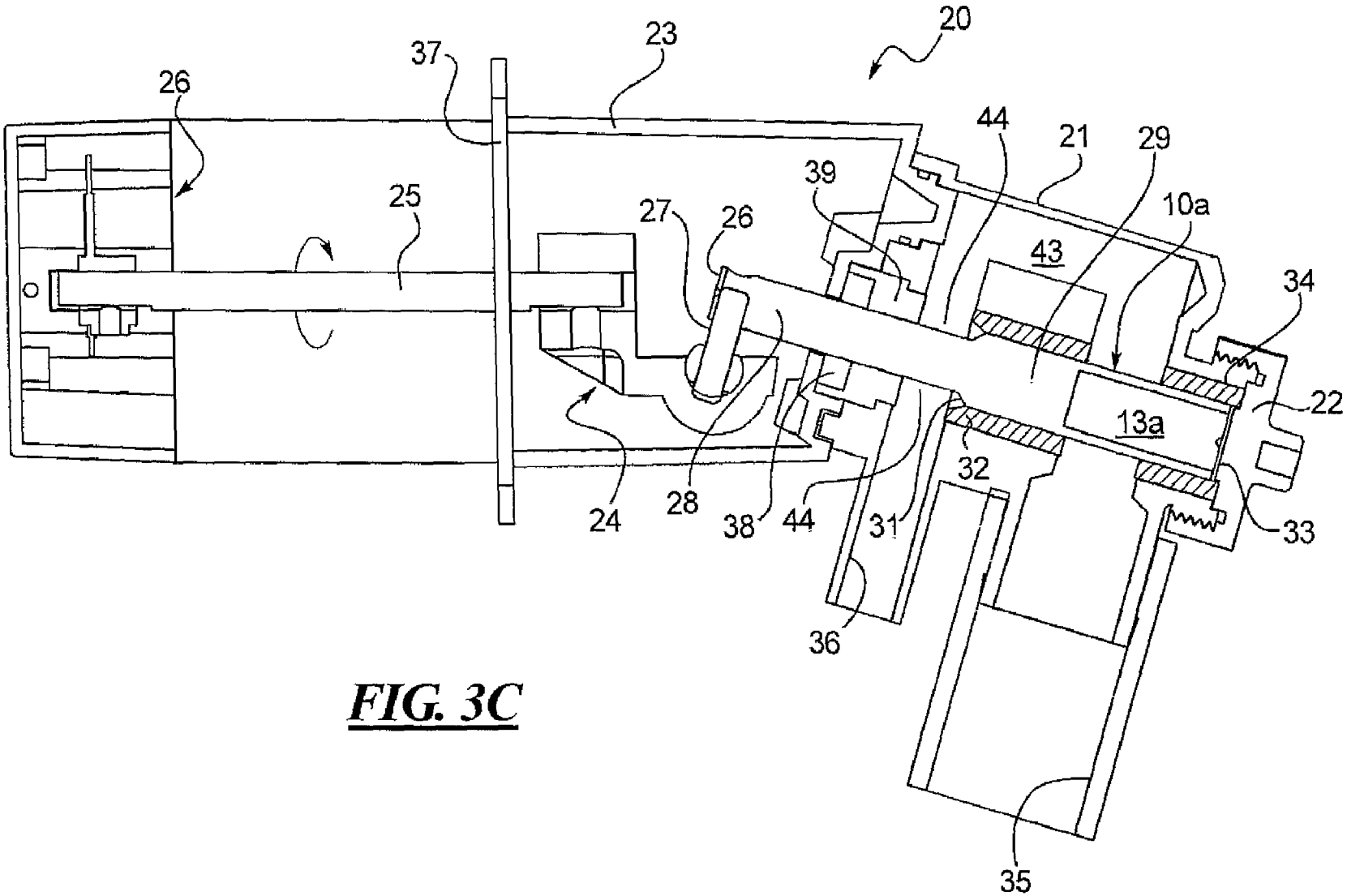
FIG. 3C is another sectional view of the pump illustrated in FIGS. 3A and 3B but with the piston rotated and moved towards the head or end cap at the top of the piston stroke with the narrow proximal portion of the piston (i.e., the narrow portion connected to the coupling) disposed in the second chamber and with the wider pump section of the piston disposed in the middle seal that separates the second from the first pump chambers.
Figure 3D:
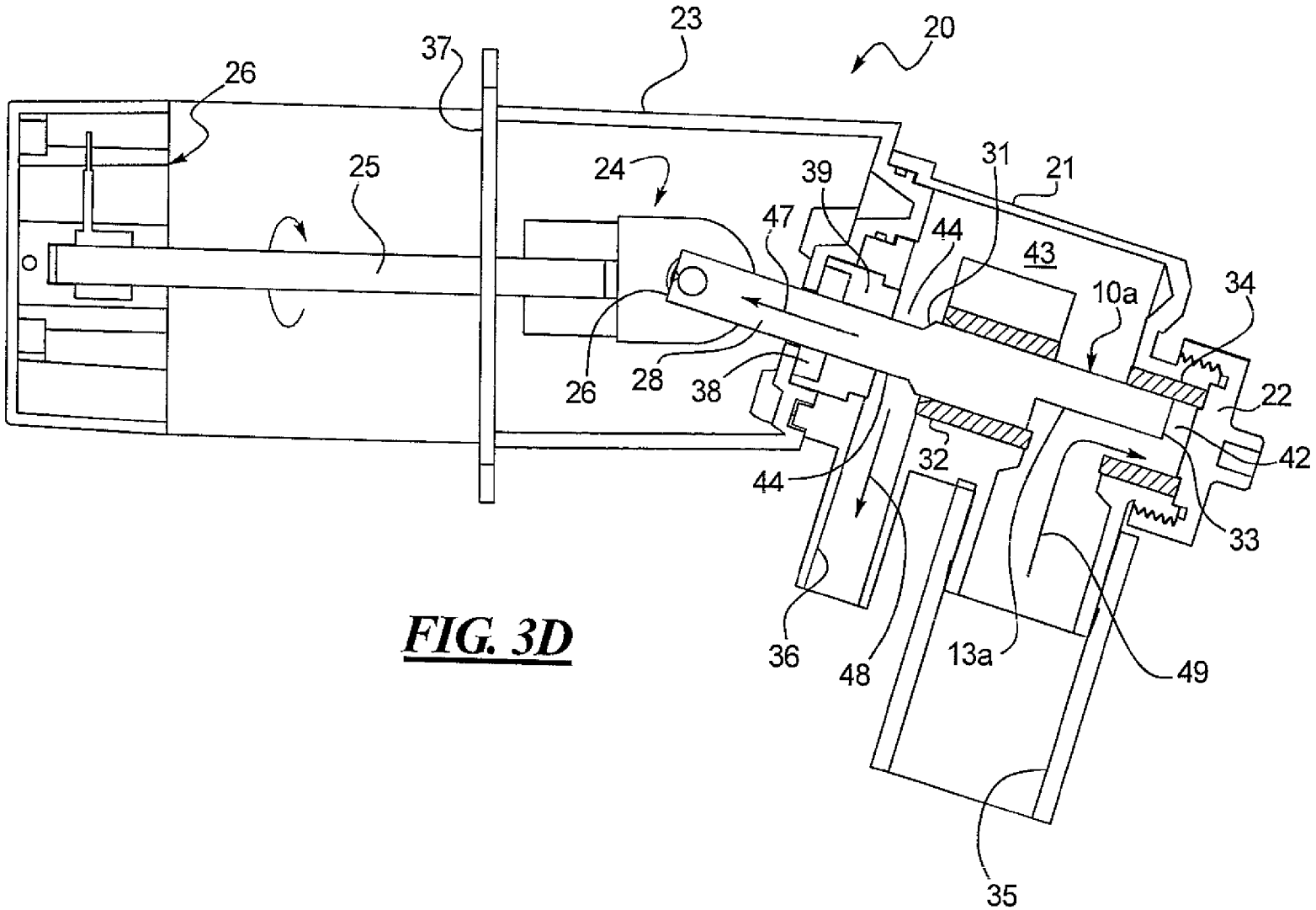
FIG. 3D is another sectional view of the pump illustrated in FIGS. 3A-3C but with the piston rotated again and moved away from the housing end cap as the piston is moved to the middle of its downstroke, and illustrating fluid entering the first chamber and exiting the second chamber.

As FIG. 3B shows the piston 10*a* in the middle of its upstroke, FIG. 3C shows the piston 10*a* at the top or end of its stroke. The distal end 33 of the pump section 29 of the piston 10*a* is now closely spaced from the head or end cap 22. Fluid has been flushed out of the first chamber or area 42 (not shown in FIG. 3C) and into the passageway 43 and second chamber or area 44 before passing out through the outlet 36. Now, a reciprocating movement back towards the position shown in FIG. 3A is commenced and illustrated in FIG. 3D. As shown in FIG. 3D, the piston 10*a* is moved in the direction of the arrow 47 which causes the transition section 31 to enter the second chamber or area 44 thereby causing fluid to be displaced through the outlet or in the direction of the arrow 48. No fluid is being pumped from the first chamber or area 42 at this point but, instead, the first chamber or area 42 is being loaded by fluid entering through the inlet and flowing into the chamber or area 42 in the direction of the arrow shown at 49.

In short, what is illustrated in FIG. 3D is the dispensing of a portion of the fluid dispensed from the first chamber or area 42 during the motion illustrated by the sequence of FIGS. 3A-3C. Instead of all of this fluid being dispensed at once and there being a lull or no dispense volume during the fill portion of the cycle illustrated in FIG. 3D, a portion of the fluid pumped from the first chamber or area 42 is pumped from the second chamber or area 44 during the fill portion of the cycle illustrated in FIG. 3D. In other words, a portion of the fluid being pumped is "saved" in the second chamber or area 44 and it is dispensed during the fill portion of the cycle as opposed to all of the fluid being dispensed during the dispense portion of the cycle. As a result, the flow is moderated and pulsing is avoided. Further, production is not compromised or reduced, but merely spread out over the entire cycle.

Figure 2:
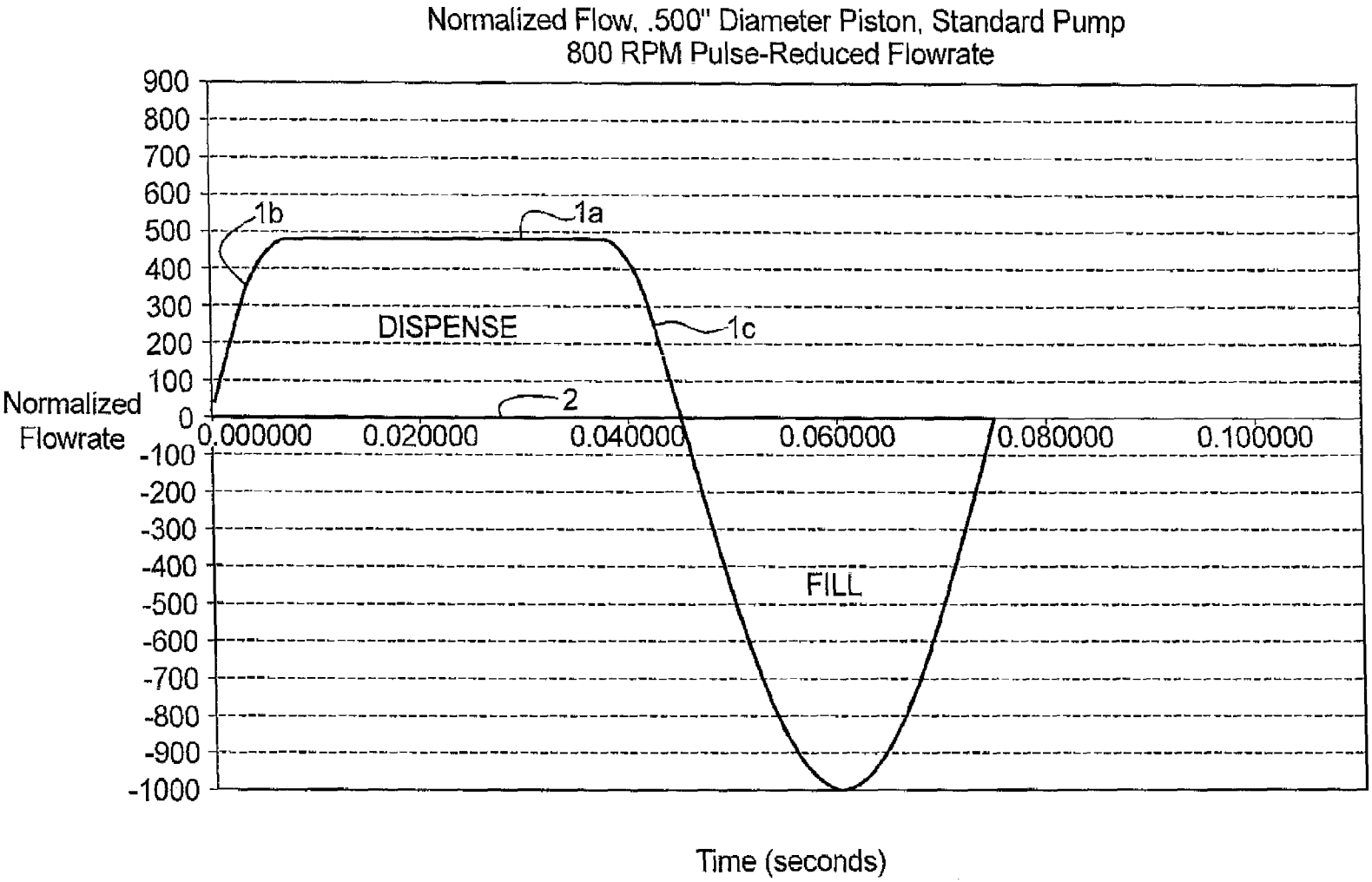
FIG. 2 (PRIOR ART)
FIG. 2 graphically illustrates a dispense and fill cycle for a prior art nutating pump operated at variable speeds to reduce pulsing.
Figure 4A:
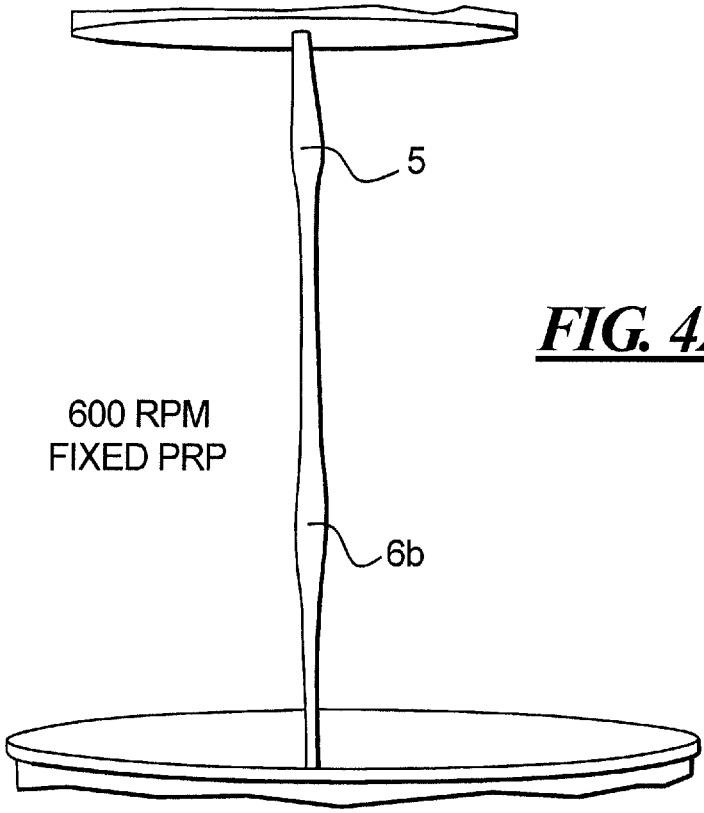
FIG. 4A is a rendering of an actual photograph of a dispense stream from the nutating pump illustrated in FIGS. 3A-3D operating at a fixed motor speed of 600 rpm.
Figure 4B:
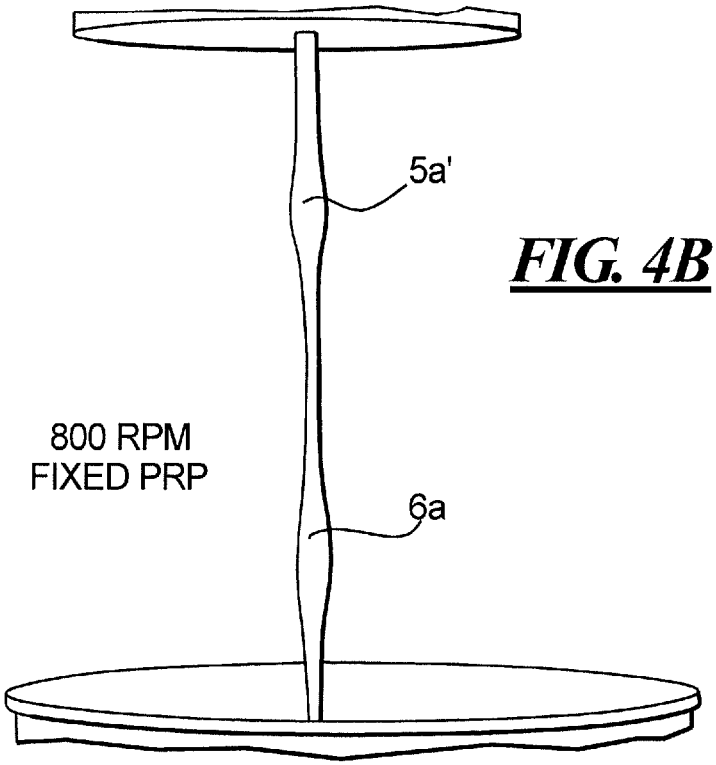
FIG. 4B is another rendering of a digital photograph of an output stream from the pump illustrated in FIGS. 3A-3D but operating at a fixed motor speed of 800 rpm and also using a fixed pulse-reduced dispense scheme.
Figure 4C:
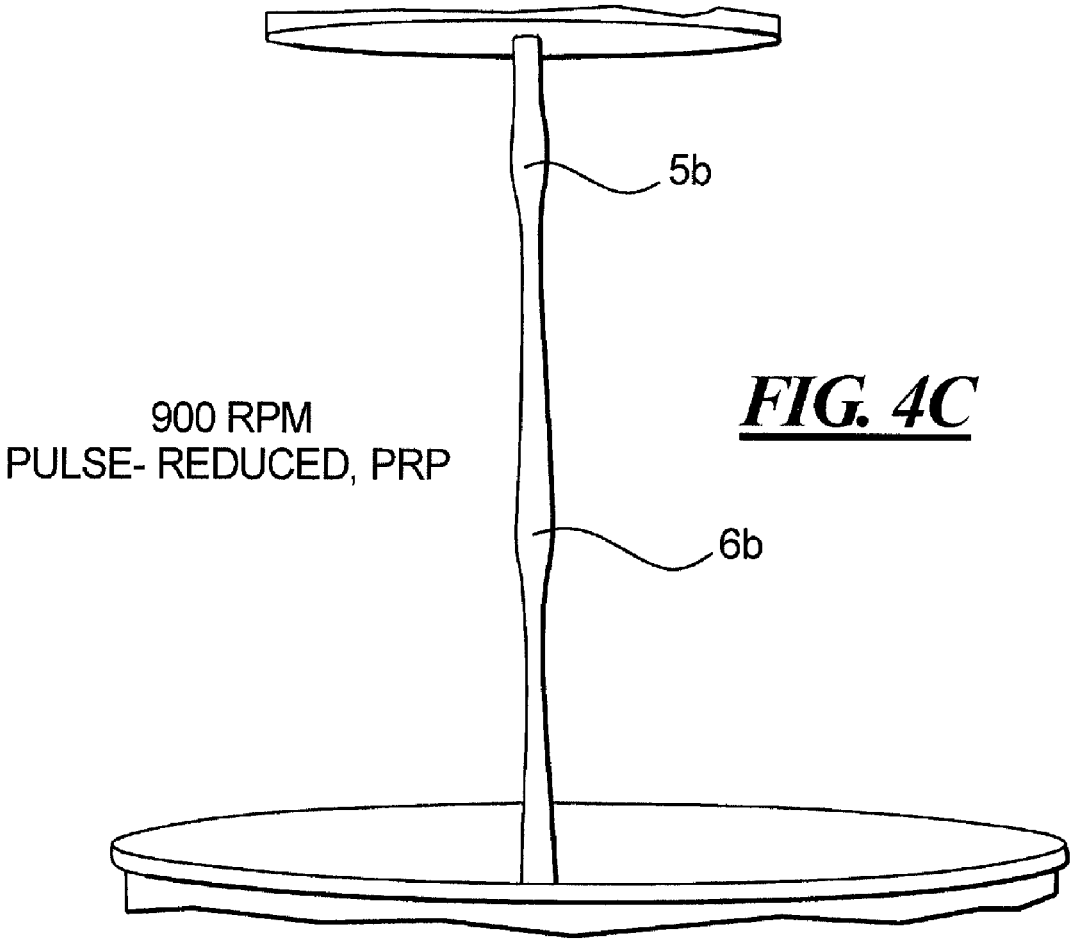
FIG. 4C is another rendering from a digital photograph of an output stream from a pump as shown in FIGS. 3A-3D operating at a maximum speed of 900 rpm and employing a variable speed pulse-reduced dispense scheme.

Turning to FIGS. 4A-4C, renderings of actual dispense flows from a pump may in accordance with FIGS. 3A-3D are illustrated. In FIG. 4A, the pump is operated at a fixed motor speed of 600 rpm. As shown in FIG. 4A, only minor increases in flow shown at 5 and 6 can be seen and no serious pulsations like those shown at 3 and 4 in FIGS. 1B and 1C are evident. Increasing the motor speed to a fixed 800 rpm results in substantially no increase in the pulsations shown at 5*a* and 6*a* in FIG. 4B. Turning to FIG. 4C, the motor speed is increased to an average of 900 rpm but the speed is varied in a scheme similar to that shown in FIG. 2 above. Again, even with increased speed, the pulsations shown at 5*b*, 6*b* are barely evident. Thus, with a pump constructed in accordance with FIGS. 3A-3D, the average speed can be increased from 600 rpm to 800 rpm with little or no increase in pulsation size. Further, the speed can be increased even more while maintaining little or no increase in pulsation size if an additional pulse reduction control scheme is implemented that will be discussed below in connection with FIG. 5C.

Figure 5A:
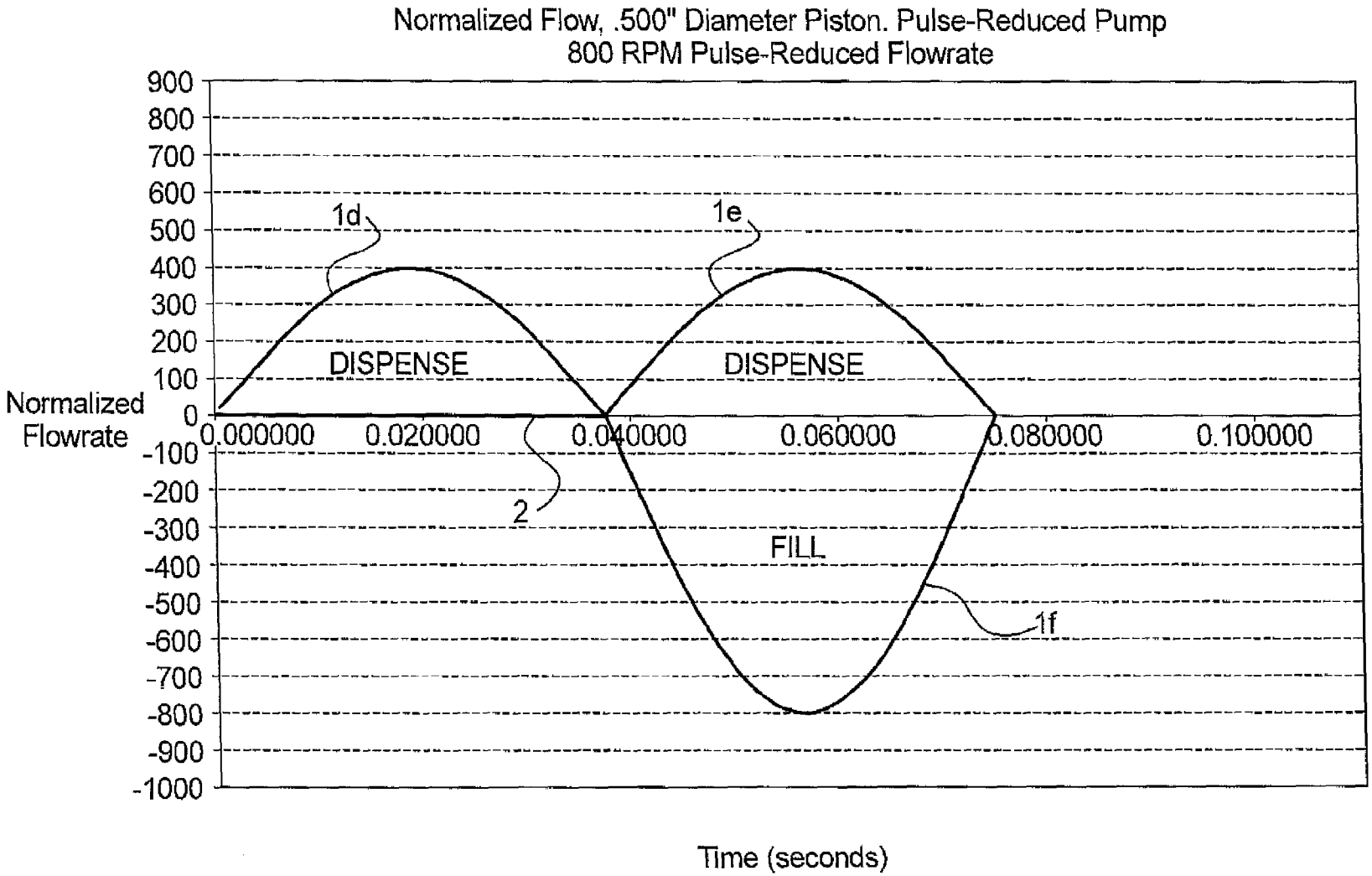
FIG. 5A graphically illustrates a dispense profile for a disclosed pump operating at a fixed motor speed of 800 rpm like that shown in FIG. 4B.

Turning to FIG. 5A, a dispense profile is shown for a pump constructed in accordance with FIGS. 3A-3D and operating at a constant motor speed of 800 rpm. Two dispense portions are shown at 1*d* and 1*e* and a fill portion of the profile is shown at If. Only a slight break in dispensing occurs at the beginning of the fill portion of the cycle and moderated dispense flows are shown by the curves 1*d*, 1*e*. FIG. 5A is a graphical representation of the flow illustrated by FIG. 4B which, again, is a rendering of a digital photograph of an actual pump in operation.

Figure 5B:
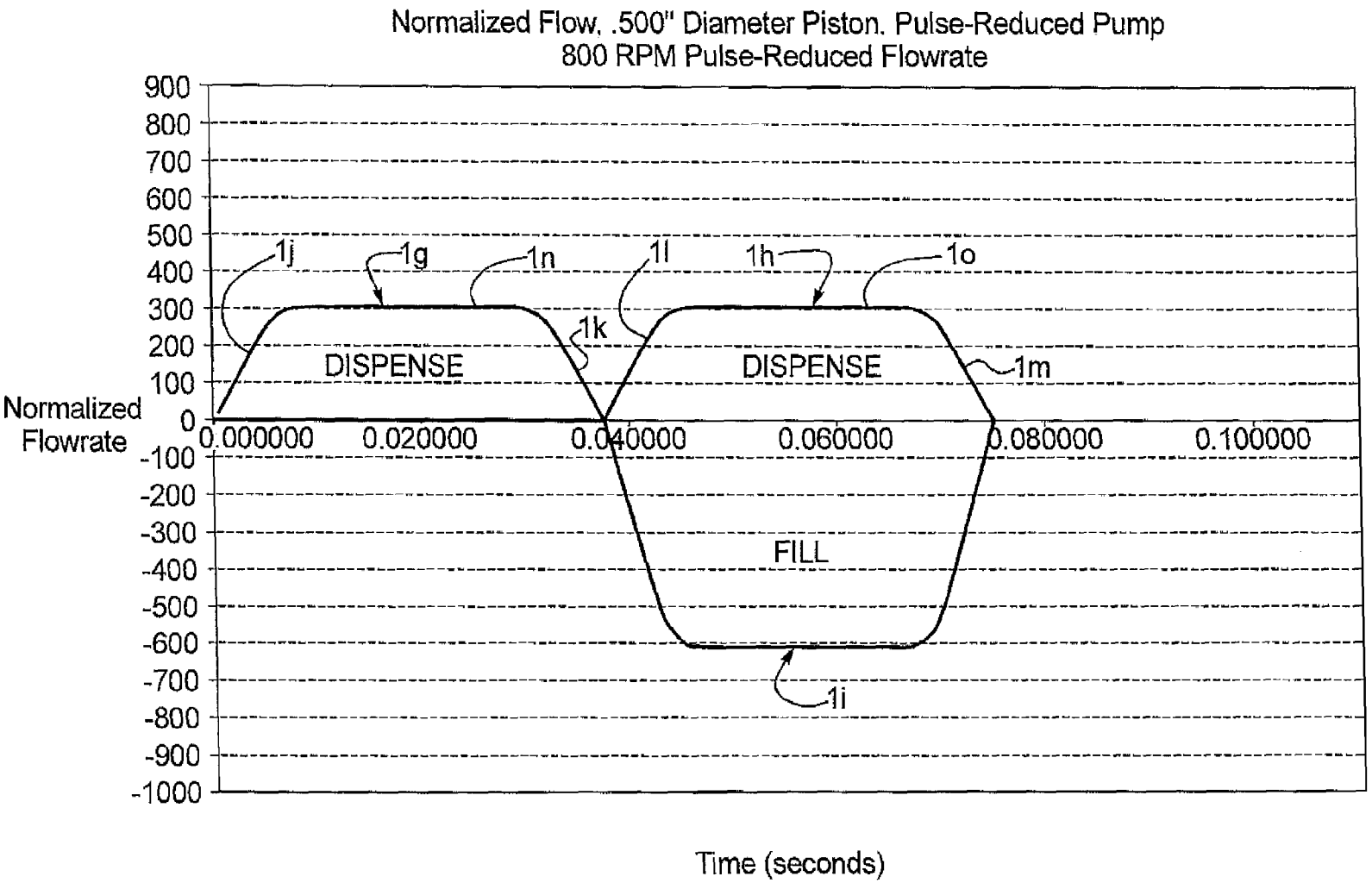
FIG. 5B graphically illustrates a dispense profile for a disclosed pump having an average motor speed of 800 rpm but with varying motor speeds to provide two modified dispense profiles, one of which occurs contemporaneously with the fill portion of the cycle.

Turning to FIG. 5B, two dispense portions of the cycle are shown at 1*g*, 1*h* and the fill portion of the cycle is shown at 1*i*. Like the scheme implemented in FIG. 2 above, the motor speed is varied to reduce the peak output flow rate by 25% from that shown in FIG. 5A by reducing the speed in the middle of the dispense cycles 1*g*, 1*h* and increasing the motor speed towards the beginning and end of each cycle 1*g*, 1*h*. The result is an increase in slope of the curves at the beginning and end of each cycles as shown at 1*j*-1*m* and a flattening of the dispense profiles as shown at 1*n*, 1*o*. This increase and decrease in the motor speed during the dispense cycle shown at 1*h* also results in an analogous flattened and widened profile for the fill cycle 1*i*.

Figure 5C:
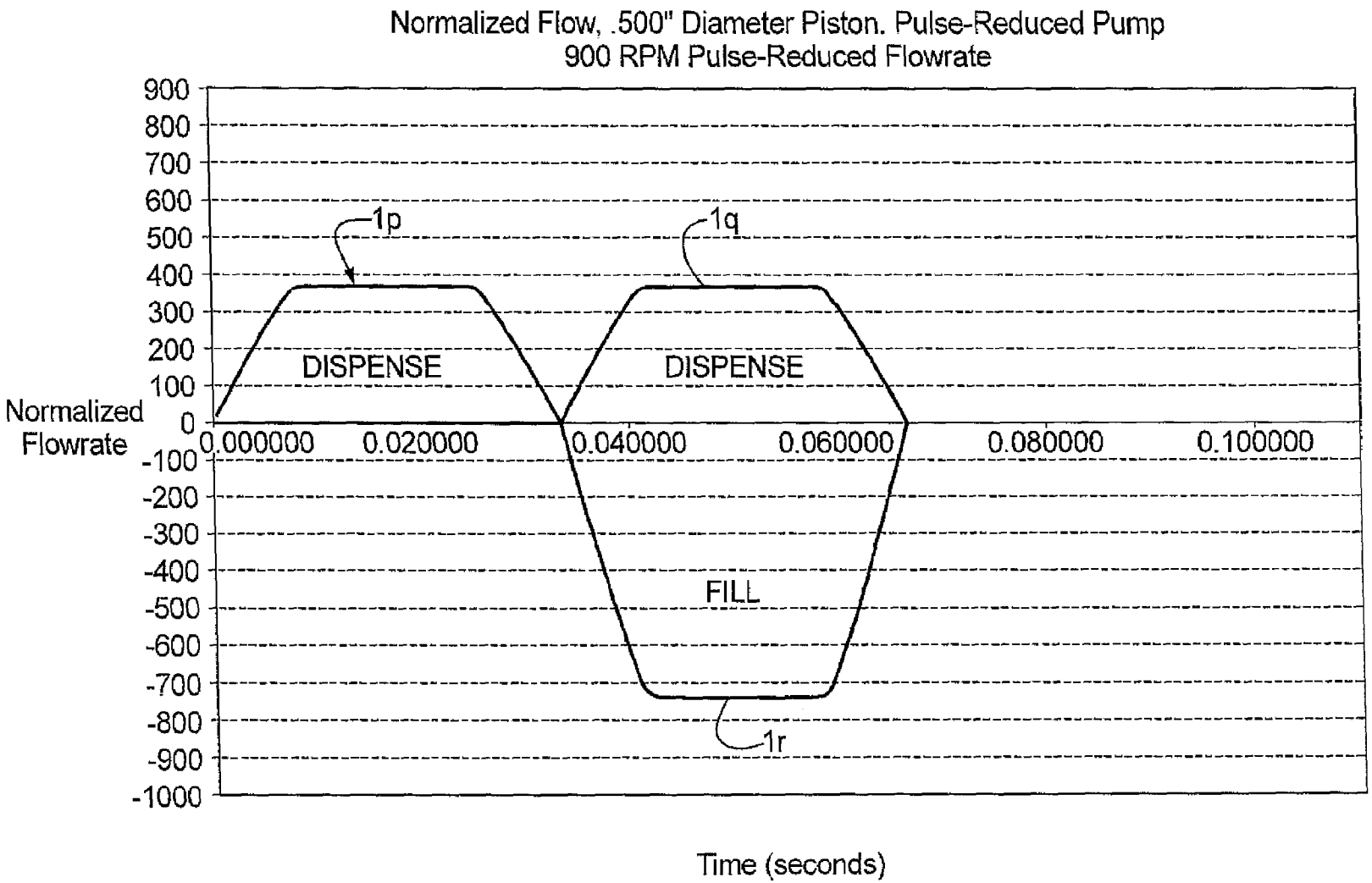
FIG. 5C graphically illustrates a dispense profile for a disclosed pump operating at an average motor speed at 900 rpm but with the motor speed varying to modify both dispense profiles, one of which occurs contemporaneously with the fill portion of the cycle.

Turning to FIG. 5C, similar dual dispense cycles 1*p* and 1*q* are shown along with a fill cycle 1*r*. However, in FIG. 5C, the average motor speed has been increased to 900 rpm while adopting the same pulse-reduction motor speed variations described for FIG. 5B. In short, the motor speed is increased at the beginning and end of each dispense cycle 1*p* and 1*q* and the motor speed during the flat portions of cycles 1*p*, 1*q* is reduced. The fill cycle 1*r* occurs simultaneously with the dispense cycle 1*q*. In terms of referring to the overall action of the piston 10*a*, the dispense cycle shown at 1*d*, 1*e*, 1*g*, 1*h*, 1*p* and 1*q* are, in fact, half-cycles of the complete piston movement illustrated in FIGS. 3A-3D.

Figure 7B:
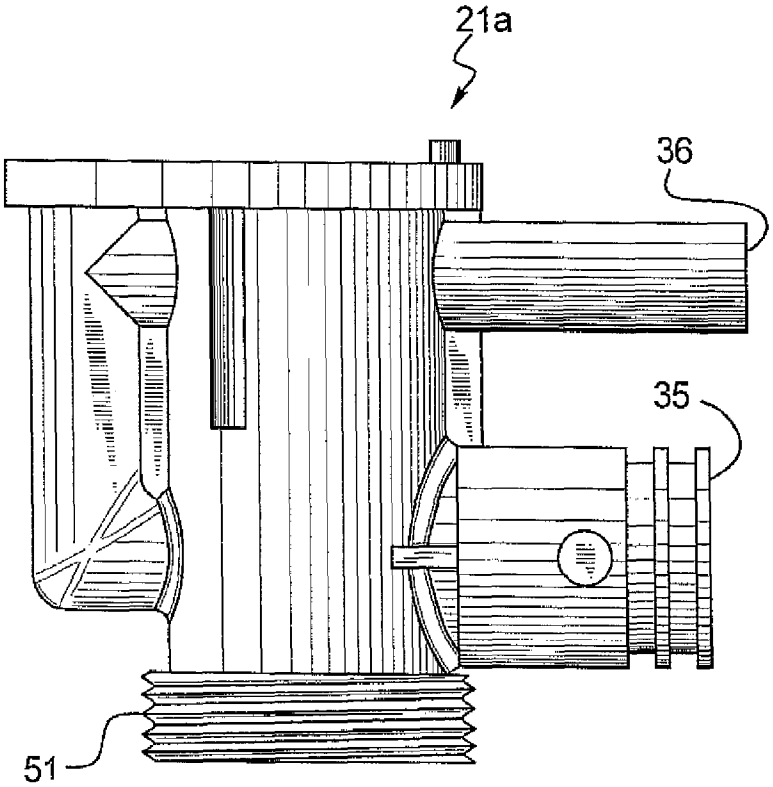
FIGS. 7A-7B are a perspective and plan view of a nutating pump housing or casing made in accordance with this disclosure.
Figure 7A:
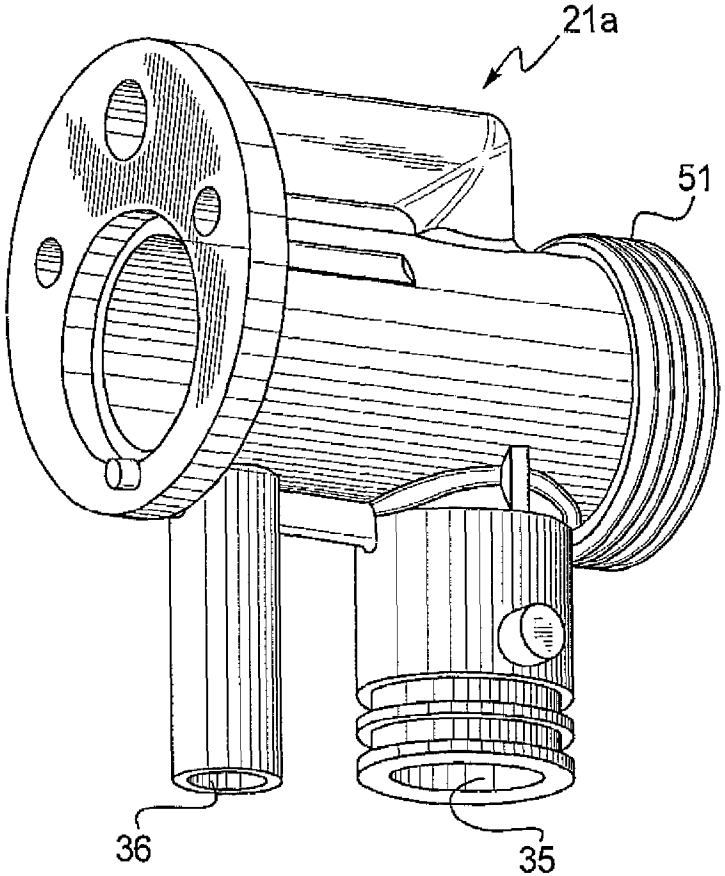

FIGS. 7A and 7B show an exemplary housing structure 21*a*. The head or end cap shown at 22 in FIGS. 3A-3C would be secured to the threaded fitting 51. The structure can be fabricated from molded plastic or metal, depending upon the application.

Figure 8A:
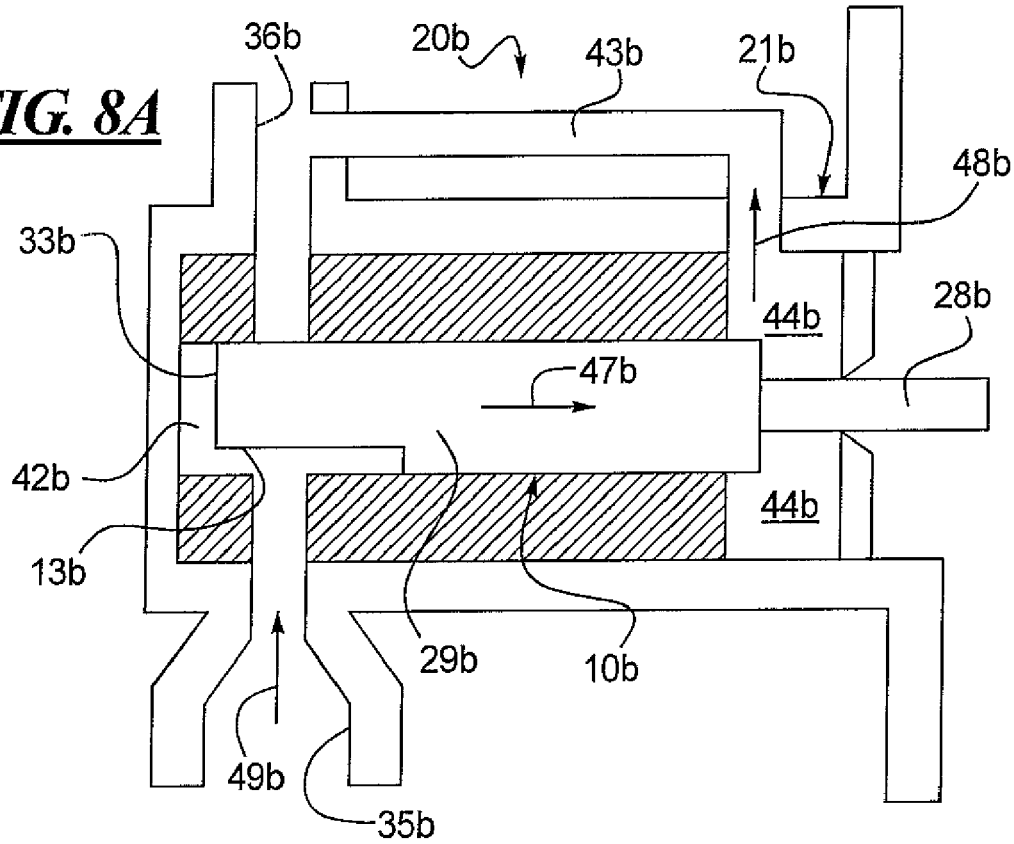
FIG. 8A is a sectional view illustrating another nutating pump made in accordance with this disclosure illustrating the piston in the middle of its downstroke.
Figure 8B:
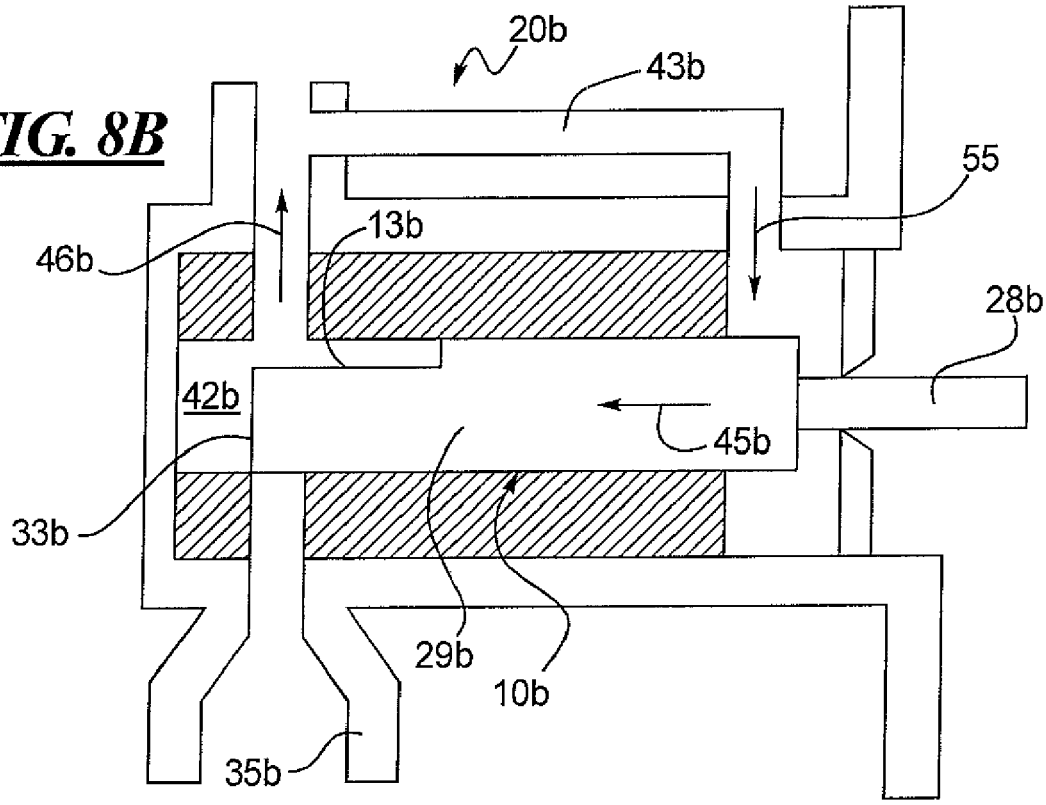
FIG. 8B is another sectional view of the pump shown in FIG. 8A illustrating the piston at the bottom of its downstroke.

Turning to FIGS. 8A-8B, an alternative pump 20*b* is shown. The pump 20*b* included a housing structure 21*b* and the passageway 43*b* extends outside of the housing 21*b*. The inlet 35*b* is in general alignment, or on the same size of the housing 21*b*, as the outlet 36*b*. The passageway 43*b* connects directly to the outlet 36*b*. The piston 10*b* includes a machined or flat section 13*b* and the pump section 29*b* includes a distal end 33*b*. The first chamber is shown at 42*b*. The proximal section 28*b* has a reduced diameter compared to that of the pump section 29*b*. Movement of the piston 10*b* in the direction of the arrow 47*b* results in displacement of fluid from the first chamber or area indicated at 44*b* and into the passageway 43*b*. Further, movement of the piston 10*b* in the direction of the arrow 47*b* as shown in FIG. 8A will also result in a loading of the first chamber 42*b* with fluid passing through the inlet 35*b* as indicated by the arrow 49*b*. Movement of fluid departing the second chamber 44*b* is indicated by the arrow 48*b*. Thus, the position of the piston 10*b* in FIG. 8A is analogous to the position shown for the piston 10*a* in FIG. 3D.

Turning to FIG. 8B, the piston is at or near the bottom of its stroke and the piston 10*b* is moving in the direction of the arrow 45*b* towards the first chamber 42*b*. As a result, fluid is pushed out of the first chamber 42*b* in the direction of the arrow 46*b*. Contemporaneously, the fluid is being loaded into the first chamber from the passageway 43*b* as shown by the arrow 55.

Figure 9A:
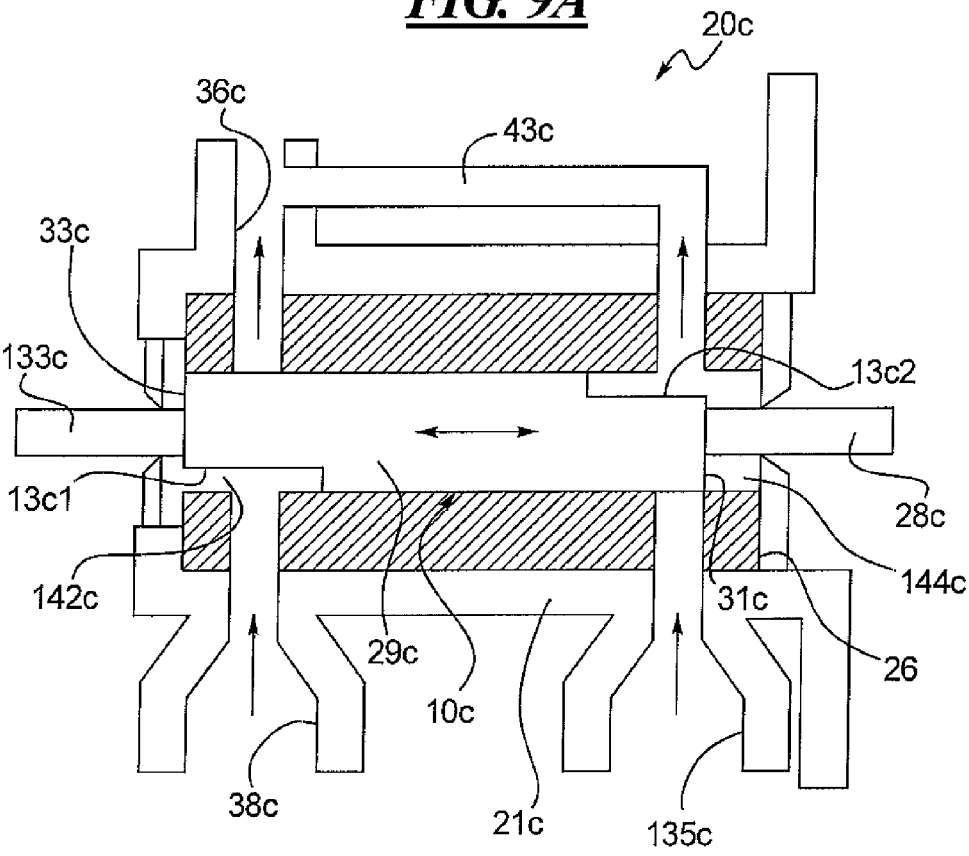
FIG. 9A is a sectional view of yet another alternative nutating pump with two flat or recessed portions on either end of the piston thereby providing for two pumping chambers, both of which have positive output and thereby requiring separate inlet ports for each pump chamber.
Figure 9B:
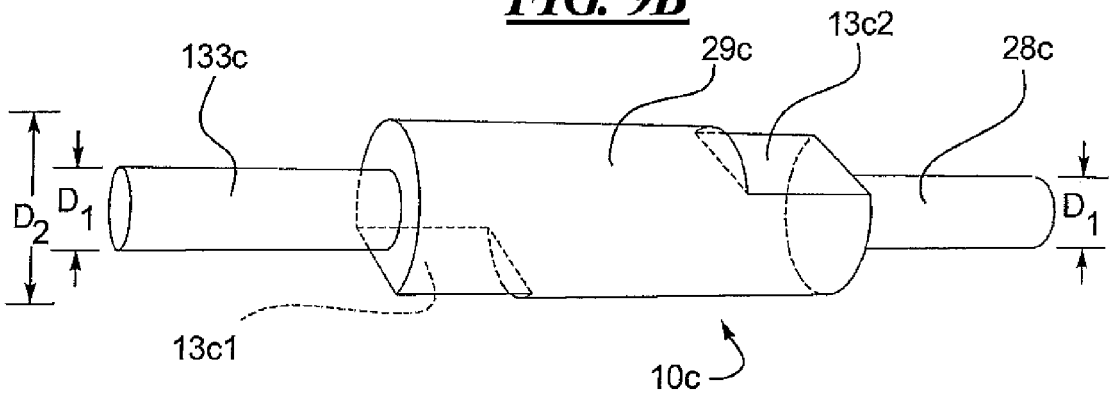
FIG. 9B is a perspective view of the piston shown in FIG. 9A.

Turning to FIGS. 9A, 9B, a nutating pump 20*c* is disclosed which includes a piston 10*c* that features a distal flat or machined section 13*c*1 as well as proximal machined or flat section 13*c*2. Thus, the piston 10*c* includes a pump section 29*c* with two pumping elements 13*c*1 and 13*c*2 based upon the axial rotation of the piston 10*c*, the piston 10*c* also includes two differences in maximum outer diameters including (a) a difference between the maximum outer diameter of the pump section 29*c* and proximal section 28*c* as well as (b) a difference between the maximum outer diameters of the pump section 29*c* and distal extension 133*c*. Therefore, lateral movement or reciprocating movement of the piston 29*c* also pumps fluid disposed in the two chambers 142*c*, 144*c*. Because both chambers 142*c*, 144*c* produce a net output as they both include conventional machined pumping elements 13*c*1, 13*c*2, respectively, as well as maximum outer diameter differences between their respective smaller sections 133*c*, 28*c* and the main pump section 29*c*.

Accordingly, the pump 20*c* needs two inlets 35*c*, and 135*c* as shown. The pump 20*c* also includes two outlets 36*c* and the conduit or passageway 43*c* which is connected to the outlet 36*c*. Of course, a separate outlet for the chamber 144*c* could be employed. Further, the passageways connecting the inlets 35*c*, 135*c* to their respective chambers 142*c*, 144*c* could be joined upstream of the passageways 142*c*, 144*c*.

Turning to FIG. 9B, in the embodiment disclosed, the distal extension 133*c* has the same maximum outer diameter as the proximal section 28*c*, designated as $D_1$. The maximum outer diameter of the pump section 29*c* is also designated as $D_2$.

The diameters may vary from the diameters shown in FIGS. 6A-6D. The ratio or relationship between $D_1$ and $D_2$ is no longer 0.7071. This is because the pump 20*c* does not divide flow from a first chamber over two halves or two portions of a complete dispense cycle or piston movement cycle. Instead, each chamber 142*c*, 144*c* generates positive output independent of the other chamber. Thus, both chambers 142*c*, 144*c* are "first" pump chambers in the sense that this label is used for FIGS. 3A-3D and 8A-8B. Therefore, a ratio of $D_1$:$D_2$ can vary and those skilled in the art will be able to find optimum values for their particular applications.

Figure 10A:
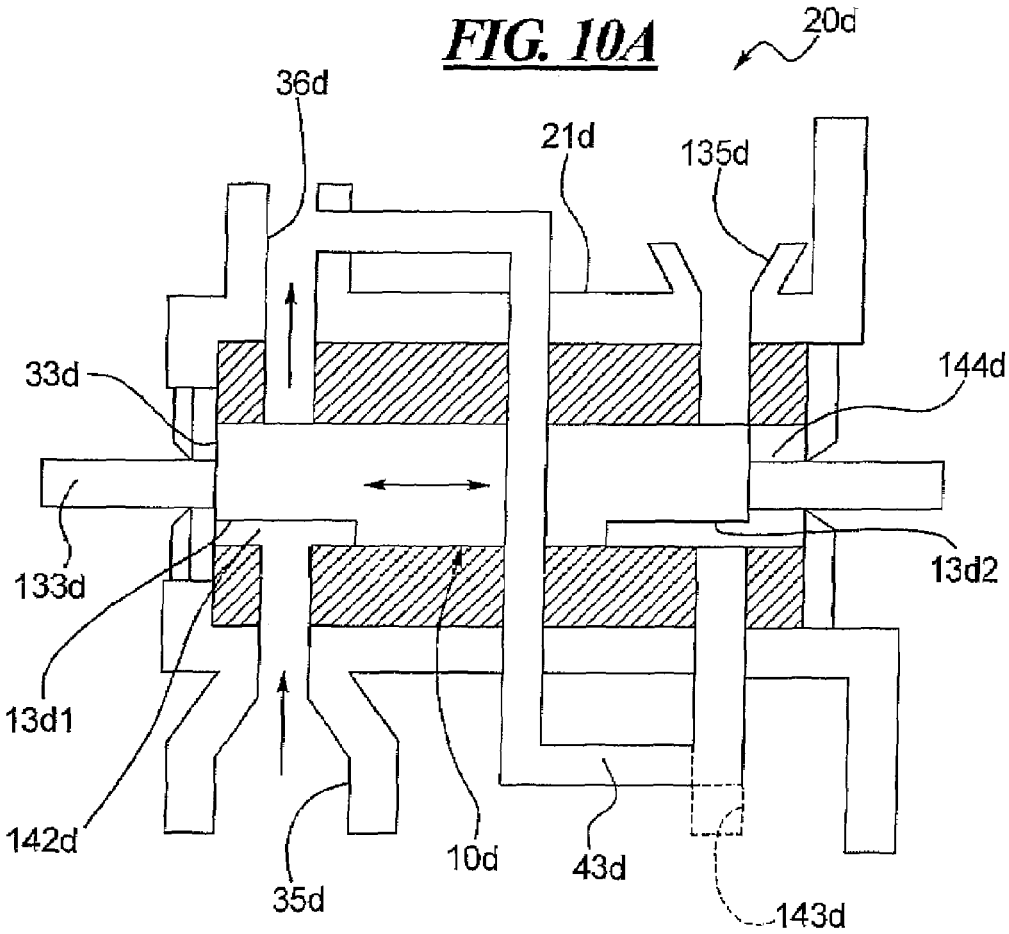
FIG. 10A is a sectional view of yet another nutating pump made in accordance with this disclosure wherein the flat or recessed portions of the piston are disposed in alignment with each other thereby necessitating the design where the inlet ports are disposed on opposite sides of the housing from each other and the outlet ports or outlet passageways also being disposed on opposite sides of the housing from one another.
Figure 10B:
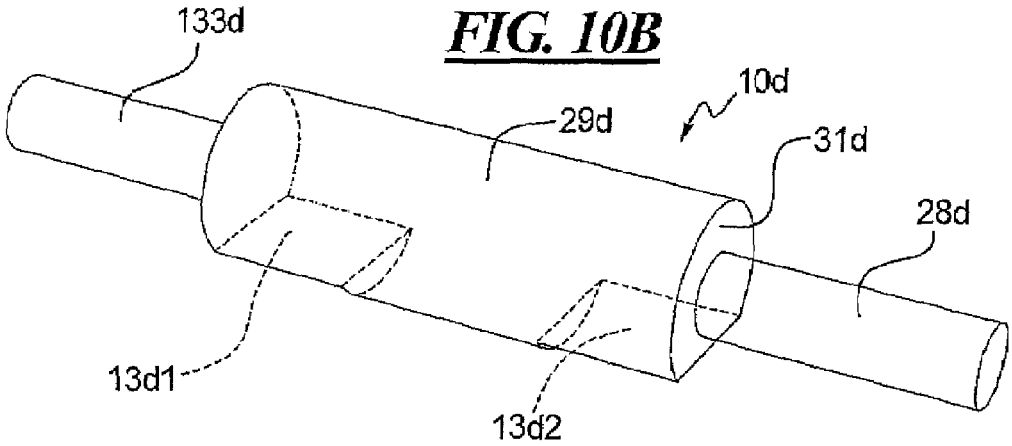
FIG. 10B is a perspective view the piston shown in FIG. 10A.

Finally, turning to FIGS. 10A-10B, another nutating pump 20*b* is disclosed which is similar to that shown in FIGS. 9A-9B. In the case of the pump 20*d*, the piston 10*d* includes two machined or flat sections 13*d*1 and 13*d*2. These machined or flat sections 13*d*1, 13*d*2 are disposed at either end of the pump section 29*d*. A distal extension 133*d* extends outward from the distal end 33*d* of the pump section 29*d*, similar to the embodiment 20*c* shown in FIGS. 9A-9B. The proximal section 28*d* terminates at the proximal end 31*d* of the pump section 29*d* which presents a vertical wall as opposed to the slanted or beveled configurations shown in FIGS. 3A-3D. The proximal end 31*c* of the piston 10*c* also presents a vertical wall. Because the machined sections 13*d*1, 13*d*2 are in alignment along the pump section 29*d* of the piston 10*d*, the orientation of the inlet ports 35*d*, 135*d* must be moved to opposite sides of the housing 21*d* so as to distribute the outputs from the chambers 142*d*, 144*d* over the entire pump cycle of the piston 10*d*. That is, with the orientation of the flat sections 13*d*1, 13*d*2 shown in FIGS. 10A-10B, if the inlets 35*d*, 135*d* were disposed on the same size of the housing 21*d* in a manner similar to the inlets 35*c*, 135*c* shown in FIG. 9A, all of the output would occur during a first half or portion of the piston cycle which, could possibly cause splashing. By orientating the inlet ports 35*d*, 135*d* to opposite sides of the housing 21 d, the output from the chamber 142 occurs in one half or one part of the cycle and the output from the other chamber 144*d* occurs in the other half or part of the cycle. Switching the inlet ports 35*c*, 135*c* to opposite sides of the housing 21*c* is not necessary for the pump 20*c* shown in FIGS. 9A-9B because the machined or flat portions 13*c*1, 13*c*2 are disposed on diametrically opposed portions of the pump section 29*c*. In the embodiment shown in 10*a*, the output passageway 43*d* from the chamber 144*d* is connected to the outlet 36*d*. This additional piping is not necessary as an additional outlet may be added at 143*d* as shown in phantom in FIG. 10A.

Thus, while the embodiments 20*c*, 20*d* shown in FIGS. 9 and 10 do not delay half or a substantial portion of the output of a first pump chamber for a second half or a second portion of a dispense cycle, the pumps 20*c*, 20*d* do perform a pulse-reduction function as the outputs of the chambers disposed on either end of the pump sections of the pistons are delivered to the output ports during different parts of the piston movement cycle. Thus, referring to FIGS. 9A-9B, the output from the chamber 142*c* is delivered during a different part of the cycle than the output from the chamber 144*c*. Similarly, referring to FIGS. 10A-10B, the output from the chamber 142*d* is delivered during a different portion of the cycle than the output from the chamber 144*d*. Therefore, pulse reduction is achieved. Further, the pumps 20*c*, 20*d* can achieve further pulse reduction by modification of the motor speeds using algorithms like that shown in FIGS. 5B-5C.

While only certain embodiments have been set forth, alternative embodiments and various modifications will be apparent from the above description to those skilled in the art. These and other alternatives are considered to fall within the spirit and scope of this disclosure.

What is claimed:

1. A pump comprising:

a single rotating and reciprocating piston disposed in a pump housing, the housing including a single inlet, a single outlet, an interior and a middle seal, the piston being unitary in structure and comprising a proximal section connected to a pump section at an annular transition section that extends between the proximal and pump sections, the proximal section being linked to a motor, the proximal section having a first maximum outer diameter, the pump section having a second maximum outer diameter that is greater than the first maximum outer diameter, the annular transition section having an inner diameter equal to about the first maximum outer diameter of the proximal section and an outer diameter equal to about the second maximum outer diameter of the pump section, the pump section comprising a distal recessed section disposed opposite the pump section from the annular transition section, the pump section extending between the annular transition section and a distal end of the piston, the pump section of the piston being at least partially and frictionally received in the middle seal of the housing, the housing and piston defining two pump chambers including a first pump chamber defined by the distal recessed section and distal end of the pump section of the piston and the housing, the first pump chamber connected to the inlet, and a second pump chamber defined by the annular transition section and proximal section of the piston and the housing, the second pump chamber connected to the outlet, the first and second pump chambers being axially isolated from each other by the middle seal, the housing further comprising a passageway connected to the first pump chamber that extends around the middle seal and provides communication between the first and second pump chambers.

2. The pump of claim 1 wherein the housing further comprises an external conduit that forms the passageway and that connects the first pump chamber to the single outlet.

3. The pump of claim 1 wherein the housing further comprises a distal seal section in which the distal end of the pump section of the piston is frictionally received.

4. The pump of claim 3 wherein the distal seal section also helps to define the first pump chamber.

5. The pump of claim 1 wherein the distal seal section abuts an end cap which also helps to define the first pump chamber.

6. The pump of claim 1 wherein the proximal section of the piston passes through a proximal seal that also helps to define the second pump chamber.

7. The pump of claim 1 wherein the piston comprises a distal extension extending from the distal end of the pump section, the distal extension having a third maximum outer diameter that is smaller than the second maximum outer diameter, the distal extension passing through a distal seal that helps define the first pump chamber.

8. The pump of claim 7 wherein the third and first maximum outer diameters are about equal.

9. The pump of claim 1 wherein the piston further comprises a proximal recessed section that helps to define the second pump chamber.

10. The pump of claim 9 wherein the distal and proximal recessed sections are in alignment with each other.

11. The pump of claim 9 wherein the distal and proximal recessed sections are disposed diametrically opposite the pump section of the piston from each other.

12. The pump of claim 1 further comprising a controller operatively connected to the motor, the controller generating a plurality of output signals including at least one signal to vary the speed of the motor.

13. The pump of claim 1 wherein the first maximum outer diameter is about 0.707 times the second maximum outer diameter whereby an area defined by the second maximum outer diameter of the pump section being about twice as large as an annular area defined by the annular transition section.

14. The pump of claim 9 wherein the second pump chamber has a net flow.

15. A pump comprising:

a single rotating and reciprocating piston disposed in a pump housing, the housing including a single inlet and a single outlet, the inlet and outlet each being in fluid communication with an interior of the housing, the housing comprising proximal seal, a middle seal, and a distal seal, the piston being unitary in structure and comprising a proximal section connected to a pump section at an annular transition section, the proximal section being linked to a motor, the proximal section having a first maximum outer diameter, the pump section having a second maximum outer diameter that is greater than the first maximum outer diameter, the annular transition section having an inner diameter equal to about the first maximum outer diameter and an outer diameter equal to about the second maximum diameter, the pump section comprising a distal recessed section disposed opposite the pump section from the annular transition section, the pump section extending between the annular transition section and a distal end of the piston, at least a portion of the pump section disposed between the distal recessed section and the first transition section being at least partially and frictionally received in the middle seal, at least a portion of the pump section that comprises the distal recessed section being frictionally received in the distal seal, the proximal section of the piston passing though the proximal seal, the housing and piston defining two pump chambers including a first pump chamber defined by the distal recessed section and distal end of the pump section of the piston, the distal seal and the housing, the first pump chamber connected to the single inlet, and a second pump chamber defined by the transition section and proximal section of the piston, the proximal seal and the housing, the second pump chamber connected to the single outlet, the first and second pump chambers being axially isolated from each other by the middle seal and a portion of the pump section of the piston disposed between the distal recessed section and the annular transition section, the housing further comprising a passageway that extends around the middle seal and provides communication between the first and second pump chambers, both the first and second pump chambers being in communication with the outlet.

16. The pump of claim 15 wherein the first maximum outer diameter is about 0.707 times the second maximum outer diameter whereby an area defined by the second maximum outer diameter of the pump section being about twice as large as an annular area defined by the annular transition section.

17. The pump of claim 16 wherein the piston comprises a distal extension extending from the distal end of the pump section, the distal extension having a third maximum outer diameter that is about equal to the first maximum outer diameter.

18. The pump of claim 15 wherein the piston further comprises a proximal recessed section that helps to define the second pump chamber.

19. The pump of claim 18, wherein the proximal recessed section pumps independently of the distal recessed section.

20. The pump of claim 18 wherein the distal and proximal recessed sections are in alignment with each other.

21. The pump of claim 18 wherein the distal and proximal recessed sections are disposed diametrically opposite the pump section of the piston from each other.

22. The pump of claim 21, wherein the proximal recessed section pumps independently of the distal recessed section.

23. A method of pumping fluid, the method comprising:

providing a pump as recited in claim 1, pumping fluid from the first pump chamber to the second pump chamber and displacing fluid from the second pump chamber through the outlet by rotating and axially moving the piston in a distal direction so the distal end of the pump section moves toward and into the first pump chamber and the annular transition section exits the second pump chamber and is accommodated in the middle seal, pumping fluid from the second pump chamber and loading fluid into the first pump chamber by continuing to rotate the piston and axially moving the piston in a proximal direction so the annular transition section enters the second pump chamber and the distal end of the pump section exits the first pump chamber.

24. The method of claim 21 wherein a plurality of pumps as recited in claim 1 are used out of phase from each other.

* * * * *